US007736286B2

(12) United States Patent
Panaiotov

(10) Patent No.: US 7,736,286 B2
(45) Date of Patent: Jun. 15, 2010

(54) EXERCISE SYSTEM UTILIZING ELASTIC BANDS

(76) Inventor: Jordan Panaiotov, 25 Diamond E. Dr., Palm Desert, CA (US) 92260

( * ) Notice: Subject to any disclaimer, the term of this patent is extended or adjusted under 35 U.S.C. 154(b) by 116 days.

(21) Appl. No.: 12/038,266

(22) Filed: Feb. 27, 2008

(65) Prior Publication Data

US 2009/0215594 A1 Aug. 27, 2009

(51) Int. Cl.
*A63B 26/00* (2006.01)

(52) U.S. Cl. ..... 482/142; 482/121

(58) Field of Classification Search ..... 482/121–130, 482/142, 148, 92–95, 35–38, 139, 14, 23–24, 482/41, 51, 106–108, 140
See application file for complete search history.

(56) References Cited

U.S. PATENT DOCUMENTS 3,345,067 A * 10/1967 Smith ..... 482/123
4,564,193 A * 1/1986 Stewart ..... 482/60
4,784,384 A * 11/1988 Deola ..... 482/99
5,013,035 A * 5/1991 Nathaniel ..... 482/129
5,290,213 A * 3/1994 Sheikowitz ..... 482/104
5,304,109 A * 4/1994 Shockley ..... 482/142
5,346,448 A * 9/1994 Sollo ..... 482/104
5,449,336 A * 9/1995 Sabel ..... 482/133
5,478,299 A * 12/1995 Harmon et al. ..... 482/124
5,626,546 A * 5/1997 Little ..... 482/129
5,688,210 A * 11/1997 Chou ..... 482/56
5,833,582 A * 11/1998 Chen ..... 482/57
5,891,004 A * 4/1999 Berry ..... 482/129
5,997,448 A * 12/1999 Duba ..... 482/121
6,090,021 A * 7/2000 Flowers et al. ..... 482/104
6,152,866 A * 11/2000 Kuo ..... 482/142
6,264,586 B1 * 7/2001 Webber ..... 482/104
6,299,568 B1 * 10/2001 Prok ..... 482/104
6,328,679 B1 * 12/2001 Croft ..... 482/129
6,685,601 B1 * 2/2004 Knapp ..... 482/104
6,740,008 B1 * 5/2004 Ho et al. ..... 482/34
6,908,417 B2 * 6/2005 Jackson ..... 482/52
6,926,648 B2 * 8/2005 Capizzo ..... 482/104
6,939,278 B2 * 9/2005 Atwell ..... 482/142
7,044,900 B2 * 5/2006 Leftheriotis ..... 482/142
7,070,546 B1 * 7/2006 Grasso ..... 482/103
7,104,938 B1 * 9/2006 Smith ..... 482/142
7,125,369 B2 * 10/2006 Endelman ..... 482/142
7,137,937 B2 * 11/2006 Croft ..... 482/142
7,226,402 B1 * 6/2007 Joya ..... 482/121
7,229,392 B2 * 6/2007 Turnbull et al. ..... 482/129
7,374,515 B2 * 5/2008 Slawinski et al. ..... 482/104
7,591,771 B2 * 9/2009 Rullestad et al. ..... 482/104
7,601,101 B2 * 10/2009 Jackson et al. ..... 482/52

(Continued)

*Primary Examiner*—Lori Baker
(74) *Attorney, Agent, or Firm*—John P. O'Banion

(57) ABSTRACT

An exercise system is disclosed that is configured to provide mounting surfaces for elastic resistance training elements. The system has a frame having first and second vertical columns and one or more supports configured to rest on a floor surface to maintain the frame in a substantially vertical orientation. The system also has first and second extendable members that are slideably disposed within the first and second vertical columns, and one or more rings coupled to the first and second extendable members that function as attachment points to secure one or more elastic resistance training elements to the system. The position of the rings is adjustable to allow a variety of exercises with the elastic training element.

22 Claims, 22 Drawing Sheets

U.S. PATENT DOCUMENTS

| | | | | |
|---|---|---|---|---|
| 7,635,323 | B2 * | 12/2009 | Halbridge | 482/130 |
| 7,641,602 | B2 * | 1/2010 | Rogers et al. | 482/100 |
| 2003/0199372 | A1 * | 10/2003 | Robinson et al. | 482/140 |
| 2005/0187082 | A1 * | 8/2005 | Bowser | 482/123 |
| 2005/0272574 | A1 * | 12/2005 | Lessard | 482/104 |
| 2006/0003877 | A1 * | 1/2006 | Harmon | 482/142 |
| 2006/0025289 | A1 * | 2/2006 | Wallach | 482/121 |
| 2006/0100075 | A1 * | 5/2006 | Harsh | 482/142 |
| 2006/0128539 | A1 | 6/2006 | Marquez | |
| 2006/0128540 | A1 | 6/2006 | Engle | |
| 2006/0135329 | A1 * | 6/2006 | Owen | 482/123 |
| 2006/0199706 | A1 * | 9/2006 | Wehrell | 482/92 |
| 2006/0258520 | A1 * | 11/2006 | Bowser | 482/121 |
| 2007/0087923 | A1 * | 4/2007 | Lamarque | 482/142 |
| 2007/0099780 | A1 * | 5/2007 | Bowser | 482/148 |
| 2007/0149373 | A1 * | 6/2007 | Dalebout et al. | 482/142 |
| 2007/0155597 | A1 * | 7/2007 | Hockemeyer | 482/99 |
| 2008/0171643 | A1 * | 7/2008 | Baudhuin | 482/148 |
| 2009/0023566 | A1 * | 1/2009 | Florczak | 482/142 |
| 2009/0054215 | A1 * | 2/2009 | McBride et al. | 482/129 |
| 2009/0215594 | A1 * | 8/2009 | Panaiotov | 482/130 |

* cited by examiner

EXERCISE SYSTEM UTILIZING ELASTIC BANDS

CROSS-REFERENCE TO RELATED APPLICATIONS

Not Applicable

STATEMENT REGARDING FEDERALLY SPONSORED RESEARCH OR DEVELOPMENT

Not Applicable

INCORPORATION-BY-REFERENCE OF MATERIAL SUBMITTED ON A COMPACT DISC

Not Applicable

NOTICE OF MATERIAL SUBJECT TO COPYRIGHT PROTECTION

A portion of the material in this patent document is subject to copyright protection under the copyright laws of the United States and of other countries. The owner of the copyright rights has no objection to the facsimile reproduction by anyone of the patent document or the patent disclosure, as it appears in the United States Patent and Trademark Office publicly available file or records, but otherwise reserves all copyright rights whatsoever. The copyright owner does not hereby waive any of its rights to have this patent document maintained in secrecy, including without limitation its rights pursuant to 37 C.F.R. §1.14.

BACKGROUND OF THE INVENTION

1. Field of the Invention

This invention pertains generally to an exercise system, and more particularly to an exercise system using elastic elements for resistance.

2. Description of Related Art

Resistance training with elastic stretch bands or tubing has become increasingly popular. By working different muscle groups with stretch bands, one can increase muscle tone, increase strength and even maintain weight. One can use a low resistance band and do more repetitions to tone, and to burn fat. Alternatively, one can stretch a higher resistance band and do fewer repetitions to increase muscle strength. Research shows that elastic resistance training (ERT) exercise offers the same or superior physiological benefits as weight machines in a gym.

Traditionally, a person training with elastic bands must either use their own body (e.g. secure an opposing end of the band under the user's foot) or find a wall, door jam or other inconvenient attachment point to secure the opposite end of the band.

Recently, devices have been developed to promote ERT exercise (see U.S. Pat. Nos. 5,997,448; 5,688,210; 5,013,035). However, these devices are all limiting with respect to the attachment points and the types of exercises that can be performed on them.

Accordingly, an object of the present invention is to provide an exercise system with a platform from which a number of different exercises may be performed by securing elastic resistance training bands to a number of different attachment points. Another object is to provide an exercise system that provides a plurality of restraining surfaces that may be used while training with elastic resistance bands. At least some of these objectives will be met in the following description.

BRIEF SUMMARY OF THE INVENTION

An aspect of the invention is an exercise system that is configured to provide mounting surfaces for elastic resistance training elements. The system has a frame having first and second vertical columns and one or more supports configured to rest on a floor surface to maintain the frame in a substantially vertical orientation. The system also has first and second extendable members that are slideably disposed within said first and second vertical columns, and one or more rings coupled to the first and second extendable members that function as attachment points to secure one or more elastic resistance training elements to the system. The position of the rings is adjustable to allow a variety of exercises with the elastic training element.

In one embodiment, the rings are disposed on a first mount that is slideably disposed on one of the first and second extendable members so that the vertical position of the first mount with respect to the frame may be varied.

In another embodiment, a horizontal beam spans the first and second extendable members. The horizontal beam has a plurality of attachment rings that provide additional attachment points for the elastic resistance training elements.

A second mount may also be slideably disposed on the horizontal beam, wherein the second mount also has one or more attachment rings. The second mount is configured to slide along the horizontal beam to vary the location of the attachment rings. Preferably, the first mount and second mount are configured to lock into place at a plurality of locations.

The frame is also configured to support a bench having a flat surface for a user to rest while performing an exercise. The bench has a first end secured to the frame and a second free end having a leg configured to support the frame on a floor surface. The bench preferably comprises a pad configured to elevate to a plurality of angles with respect to a floor surface.

In another embodiment, an elevated work surface attached to one of the vertical columns. The elevated work surface (e.g. preacher curl) providing a platform to rest a body member while loading said one or more elastic elements.

In addition, one or more lower attachment points may be coupled to the frame at locations at or near the floor surface. The lower attachment points may be located on a frontal support, and/or the leg of the bench.

Another aspect of the present invention is an exercise system having a frame with first and second vertical columns, and one or more supports configured to rest on a floor surface to maintain the frame in a substantially vertical orientation. The system has a bench with a first end attached to a horizontal beam spanning the first and second vertical columns, and a second end having a leg to support the bench on a floor surface. The bench has a planar surface from which a user can rest at least a portion of the body. There are one or more lower attachment rings coupled to the frame, wherein the lower attachment rings are at a location on the frame that is below the planar surface of the bench. The attachment rings function as attachment points to secure one or more elastic resistance training elements to the system from which the user can train a body member while resting at least a portion of the body against the bench.

The system of the current aspect also preferably includes one or more upper attachment rings coupled to the frame, wherein the upper attachment rings are at a location that is above the planar surface of the bench.

The system of the current aspect may also have first and second extendable members slideably disposed within the first and second vertical columns. The upper attachment rings are coupled to the first and second extendable members so that the position of the upper attachment rings is adjustable to allow a variety of exercises with the elastic training element. The upper attachment rings may be disposed on a first mount slideably disposed on one of the first and second extendable members so that the vertical position of the first mount with respect to the frame may be varied.

There may also be a horizontal beam spanning the first and second extendable members and having one or more attachment rings to provide additional attachment points for the elastic resistance training elements.

The lower attachment points may be coupled to the frame at locations at or near the floor surface, for example at the bench foot to facilitate leg training.

Another aspect is an exercise system for use with elastic resistance training elements. The system has a frame having first and second vertical columns and one or more supports configured to rest on a floor surface to maintain the frame in a substantially vertical orientation. First and second extendable members are slideably disposed within the first and second vertical columns. A first set of attachment rings are coupled to the first and second extendable members to function as attachment points to secure one or more elastic resistance training elements to the system. The position of the first set of attachment rings is vertically adjustable to allow a variety of exercises with the elastic training element. A horizontal beam spans the first and second extendable members, and has a second set of attachment rings coupled to the horizontal beam, wherein the position of the second set of attachment rings is horizontally adjustable.

In one embodiment of the current aspect, the first set of rings are disposed on a first mount that is slideably disposed on one of the first and second extendable members so that the vertical position of the first mount with respect to the frame may be varied. The second set of rings are disposed on a second mount that is slideably disposed on one of the horizontal beam so that the horizontal position of the second mount with respect to the frame may be varied.

Further aspects of the invention will be brought out in the following portions of the specification, wherein the detailed description is for the purpose of fully disclosing preferred embodiments of the invention without placing limitations thereon.

BRIEF DESCRIPTION OF THE SEVERAL VIEWS OF THE DRAWING(S)

The invention will be more fully understood by reference to the following drawings which are for illustrative purposes only:

DETAILED DESCRIPTION OF THE INVENTION

Referring more specifically to the drawings, for illustrative purposes the present invention is embodied in the apparatus generally shown in FIG. 1 through FIG. 26. It will be appreciated that the apparatus may vary as to configuration and as to details of the parts, and that the method may vary as to the specific steps and sequence, without departing from the basic concepts as disclosed herein.

Figure 1:
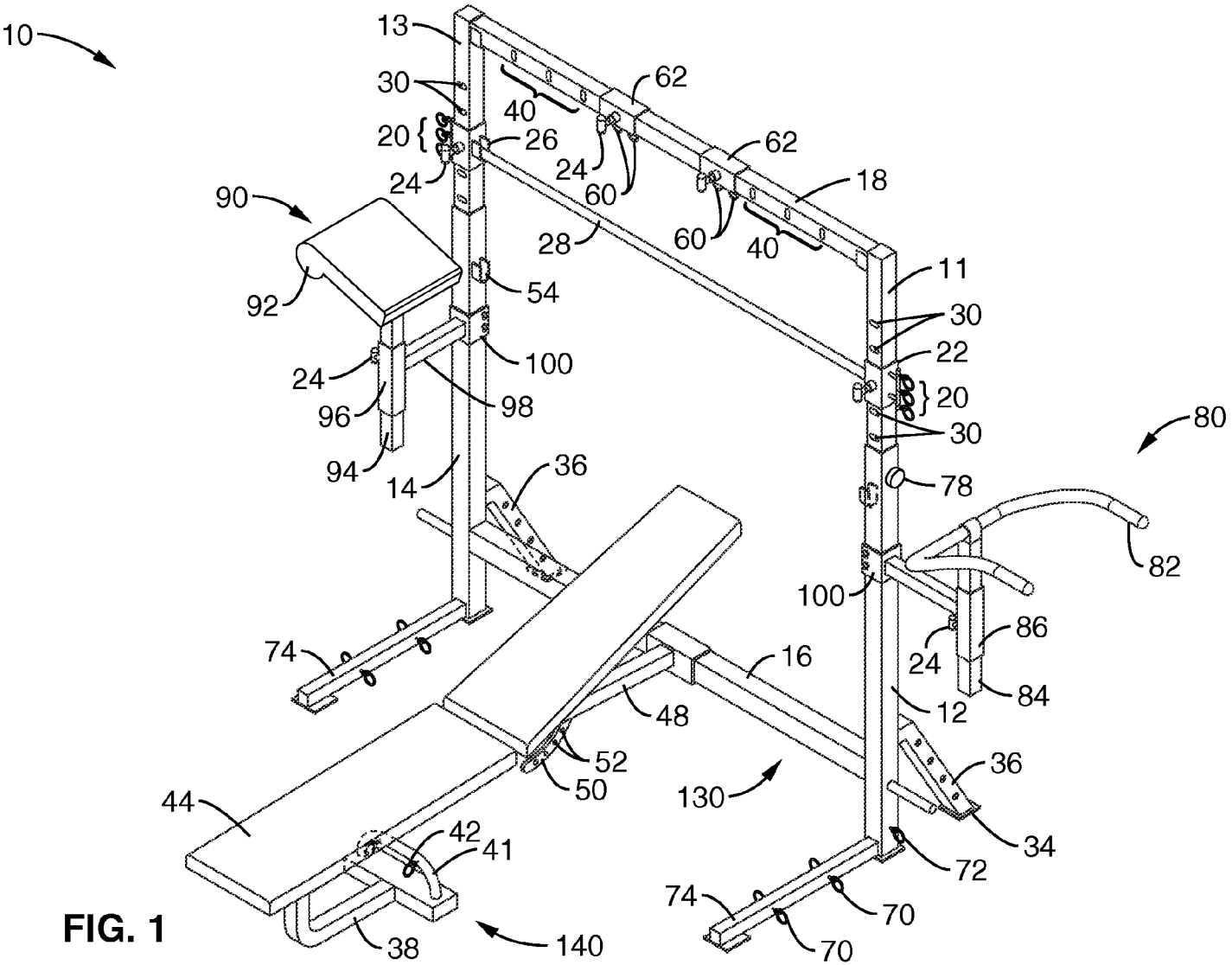
FIG. 1 is perspective view of the elastic resistance training system of the present invention.

FIG. 1 illustrates a perspective view of the elastic resistance training (ERT) system 10 of the present invention. System 10 generally comprises a base frame 130 having two spaced-apart vertical columns 12 and 14. Vertical columns 12 and 14 generally comprise heavy gauge rectangular or square tubing that are configured to receive vertical extensions 11 and 13.

The vertical columns 12 and 14 are coupled to each other via horizontal brace 16 at the lower end of the columns 12, 14, and are configured to rest on a floor or ground surface via footings 34. The frame 130 is supported in a vertical position via a pair of rear supports 36 that emanate at horizontal beam 16 and angle toward the floor to footings 34. The rear supports 36 are spaced apart to be at or near the vertical columns 12 and 14.

A pair of forward supports 74 may also be included, each with footings 34 to provide stability to the vertical columns 12, 14 while under loading. The forward supports 74 also serve to anchor one or more lower ringed attachments points 70. As will be described in further detail below, the lower ringed attachment points 70 may be used in combination with bench 140 or curl assembly 90 to perform various exercises.

The frame 130, which primarily comprises the horizontal columns 12, 14, horizontal beam 16, and rear and forward supports 36 and 74, serves to support the system 10 in an upright position under loading from the elastic resistance elements and other training activities. A number of attachment points are provided to secure the bands at different positions and orientations so that a wide variety of exercises may be performed.

For example, vertical mounts 22 are configured to support a plurality of rings 20 (three are shown in FIG. 1, however, any number may be employed) that serve as attachment points for elastic resistance training elements such as an elastic band or tubing. The vertical mounts 22 are slideably coupled to vertical extensions 11 and 13 so that the vertical position of the mounts 22 may be adjusted, and therefore the position of the rings 20 with respect to the floor or other working surface of the system 10 may also be adjusted. This mobility of the attachment points allows for numerous variation of the angle of the resistance elements with respect to the user's body to provide the exact motion desired for a particular exercise.

The vertical mounts have a spring-loaded pin 24 that is configured to slide into locking holes 30 that are vertically oriented on the vertical extensions. To move the vertical mount, the pin 24 is retracted out of the hole 30, allowing the mount 22 to move to another location along the corresponding vertical extension 11, 13. Once the vertical mount is positioned at the desired location, the pin is released to lock into the new hole 30.

Further adjustment may also be obtained by extending or retracting the vertical extensions 11, 13 in the vertical columns 12, 14. This is done by releasing knob 78 to allow the vertical extensions 11, 13 to slide freely in the vertical columns 12, 14, and then locking the vertical extensions 11, 13 by tightening knobs 78 once the proper location is found. Knob 78 may comprise a threaded pin or screw that applies a pressure to the outer surface of the vertical extension 11, 13. Alternatively, the securing mechanism 78 may also comprise a pull-pin like that of 24, with additional locking holes on the corresponding facing surface of the vertical extension 11, 13. The vertical extensions 11, 13 preferably comprises a non-stick coating, such as a chrome coating or the like, to allow the vertical mounts 22 to freely slide on the vertical extensions 11, 13, and to allow the vertical extensions to freely slide within the vertical columns 12, 14.

Further or fine adjustment of the attachment point 20 may be obtained by selection of the particular ring 20 from which to anchor the elastic tube. For example, one can select the lower, middle, or upper ring 20 for the desired attachment. The multiple rings 20 at each vertical mount also serve to allow the user to double or triple-up on the resistance tubing to increase the resistance for the exercise.

Figure 9:
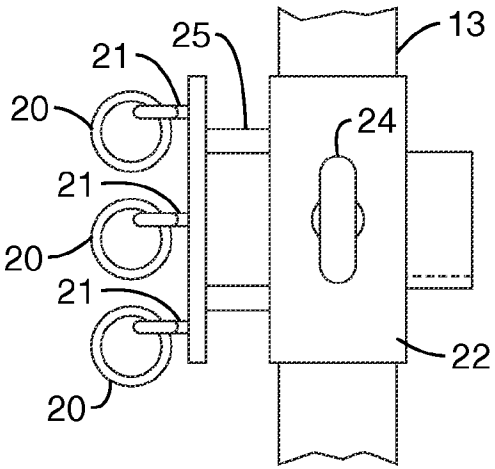
FIG. 9 is a side-view of a vertical mount in accordance with the present invention.

FIG. 9 illustrates a close-up side view of the vertical mount 22 retained on extension 13. The vertical mount generally comprises a tubular member having an inner surface that is slightly larger than the outer surface of the vertical extension 13. Rings 20 are retained in eyelets 21 such that they can freely rotate from side to side, as well as vertically. The eyelets are retained in a standoff 25 that is spaced apart from the mount 22 to allow for additional clearance for the resistance bands to be used from a variety of angles.

Figure 8:
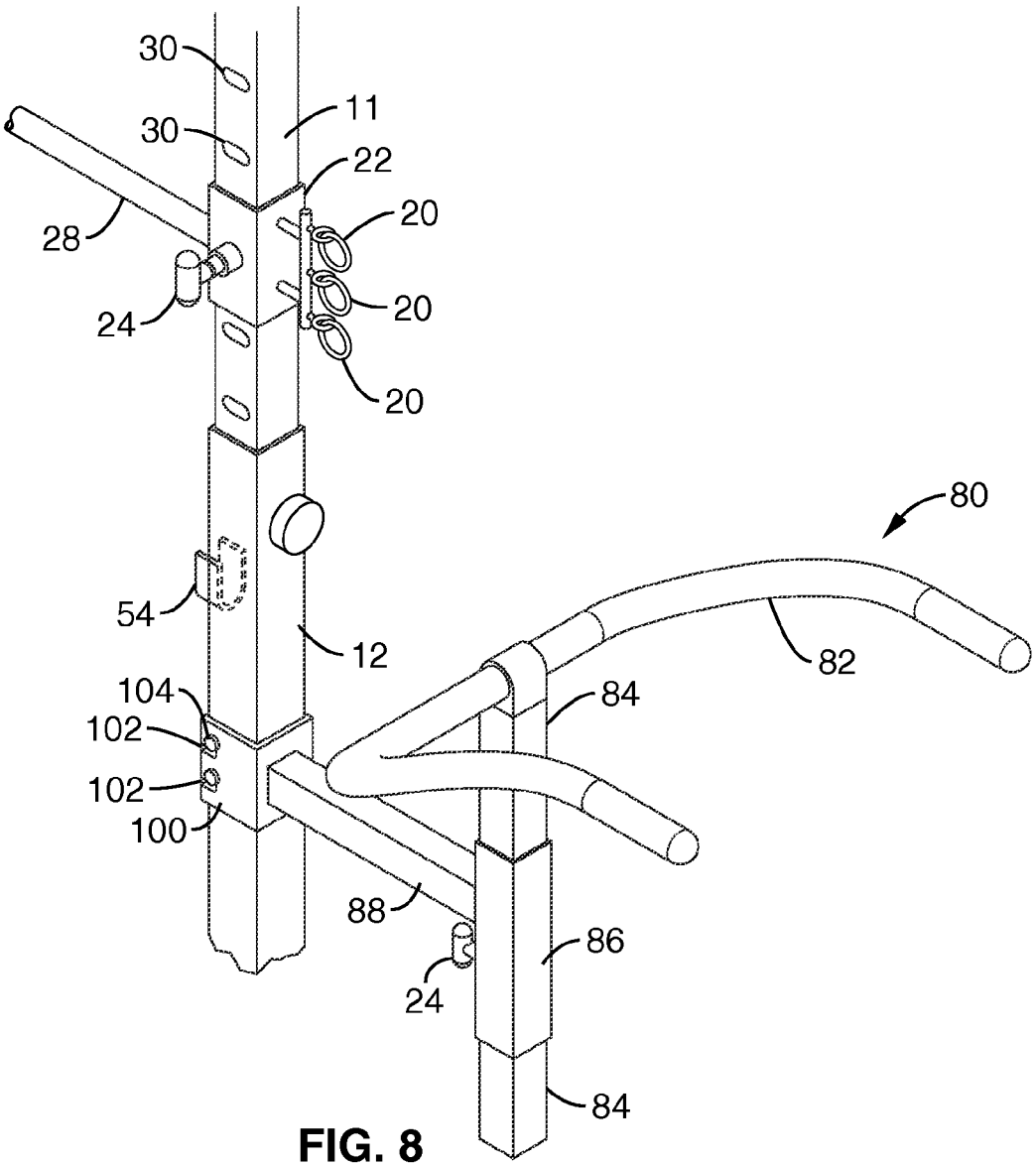
FIG. 8 is a close-up view of the dip assembly of FIG. 1.

Each of the vertical mounts also comprises a u-shaped protrusion 26 on the opposing surface from the eyelets 21 and standoff 25. The protrusion 26 acts to retain a horizontal bar 28, as seen in FIG. 1. Thus the bar 28 may be readily interchanged depending on the exercise to be performed. The level of the bar 28 may also be varied by orienting the vertical mounts 22 to a particular location along vertical extensions 11, 13. As seen in FIGS. 1 and 8, a similar u-shaped protrusion 54 may also be positioned on the inner surfaces of the columnar supports 12, 14. This provides an additional mount location for bar 28.

Referring back to FIGS. 1-4, the system 10 is also configured with a bench 140 coupled to the front side of the frame 130. The bench 140 is supported by a leg 38 that is securely attached to a front support member 64 and aft support member 48. The front support member 64 provides support for fixed pad 44, and the aft support member 48 provides support for movable pad 46, both pads 44 and 46 providing a platform for one to sit or lay on while performing exercises.

Figure 2:
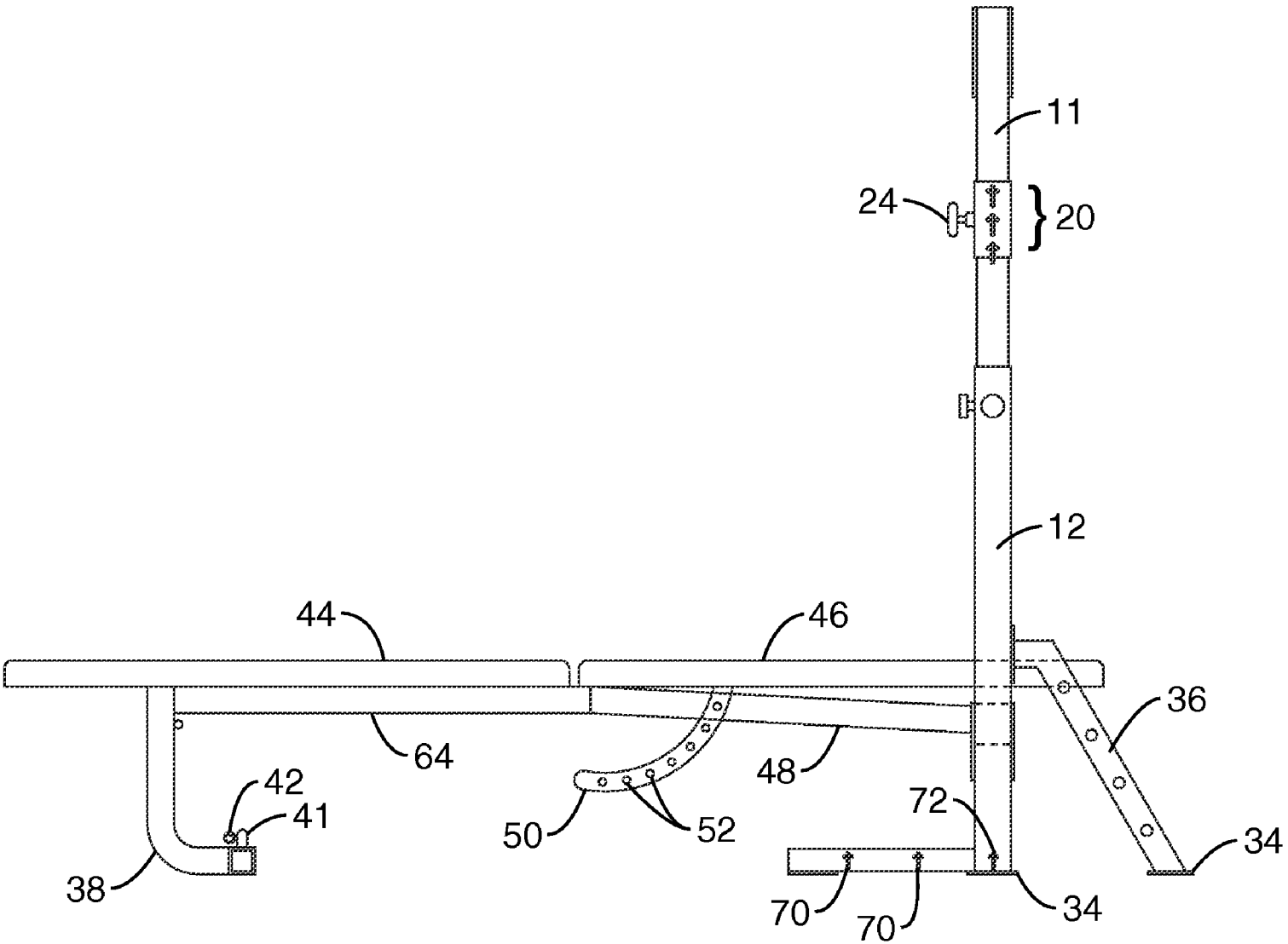
FIG. 2 is a side view of the system of FIG. 1.

As shown in FIG. 2, the front support member is generally horizontal, while the aft support member 48 slopes downward from the front support member 64 to connect with the horizontal beam 16. Moveable pad 46 is configured to incline up to 90 degrees beyond horizontal via hinge 68 that is located at or near the junction of the front support member 64 and aft support member 48.

Figure 3:
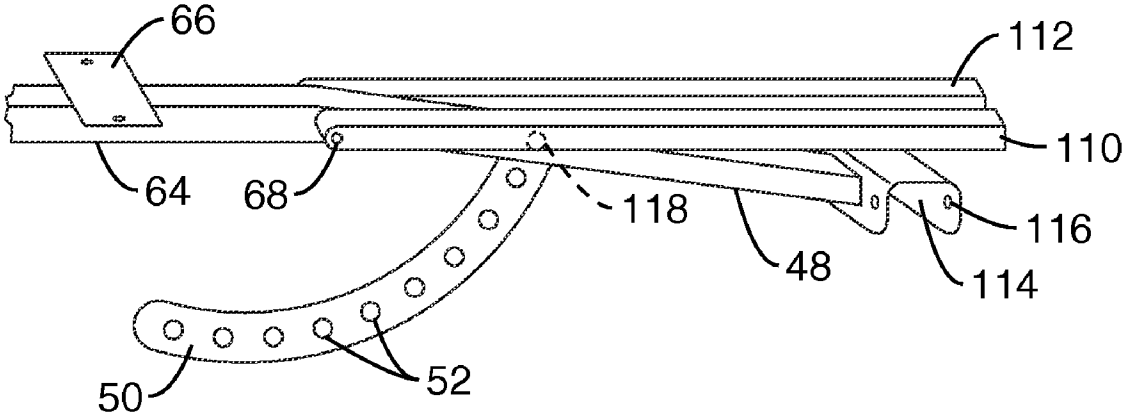
FIG. 3 shows a perspective view of the support members for the bench shown in FIG. 1, with the padding removed.

FIG. 3 illustrates a view of the aft end of the bench with the moveable pad 46 removed. The pad 46 rests on two parallel rotation members 110 and 112 that are rotatably coupled to support 64 at hinge 68. The rotation members 110, 112 are coupled to the rear support member 48 via arm 50. Arm 50 has a generally arcuate shape with a plurality of locking holes 52 spaced in intervals along its length.

Figure 4:
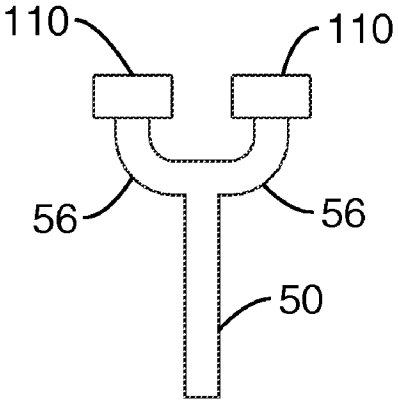
FIG. 4 illustrates a frontal view of the arm and its interface with rotating supports and aft support member of the bench.

FIG. 4 illustrates a cross sectional view of arm 50 and its interface with rotating supports 110, 112 and aft support member 48. The top section of arm 50 forms an offset U-shaped end 56 that is attached to rotating members 110 and 112. The U-shaped und 56 is configured to support the rotation members 110, 112 above the aft support member 48. The aft support member 48 is sloped downward so that the moveable pad has enough clearance to at least be positioned horizontal with respect to the ground (it is appreciated that the aft support member 48 may be sloped enough to allow the moveable pad 46 to decline with respect to the fix pad 44). The arm 50 is configured such that, as the movable pad 46 moves through its range of motion, the locking holes 52 line up with the through hole 118 in the aft support member 48 so that locking pin 117 may be inserted through both locking hole 52 and through hole 118 to loch the position of the moveable pad 46 with respect to the fixed pad 44.

As shown in FIG. 3, the aft support member 48 has a bracket 114 at its free end that secures to the horizontal beam 16. The support member may be welded to the beam 16, or be fastened with a bolt through holes 116. The pads are preferably secured to the supports 64, 110, 112, via plates 66 (see also FIG. 5)

Figure 5:
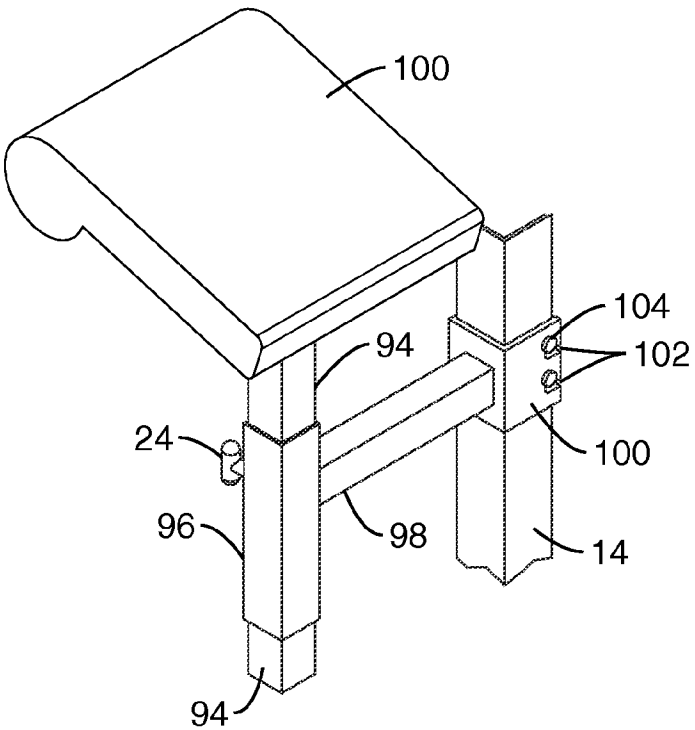
FIG. 5 is a perspective view of the curl assembly shown in FIG. 1.

Referring to FIG. 5, interfacing plates 120 may be used to secure leg 38 to support 64 via bolts 122. Alternatively, the two members may be welded together. The leg 38 is also preferably configured with riser bar 41 that supports a pair of attachment rings 42 for additional attachment points for the elastic tubing.

Figure 6:
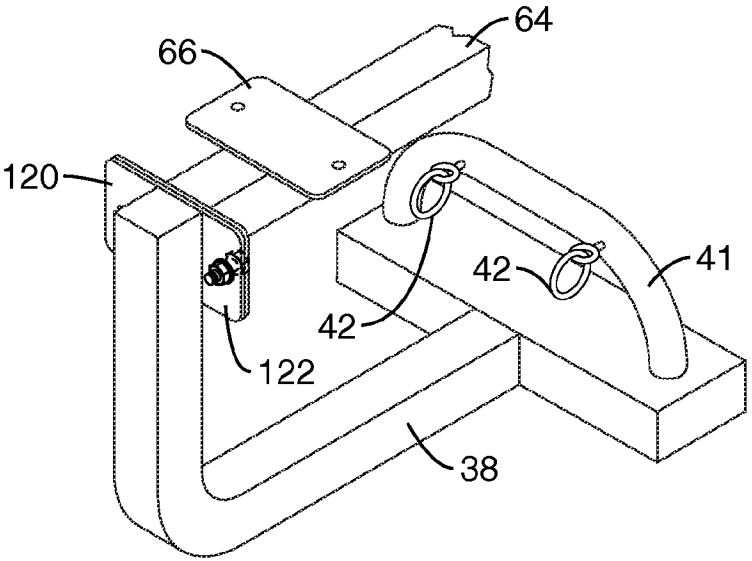
FIG. 6 illustrates a perspective view of the foot for the bench shown in FIG. 1, with the padding removed.

Referring now to FIGS. 1 and 6, the system 10 may also be equipped with a detachable elevated curl assembly 90. Curl assembly 90 comprises pad 92 that is secured to neck 94. The neck 94 is shaped and sized to be slideably received in stem 96 of arm 98. The neck is retained at a vertical position in stem 96 by use of a pull pin 24 or like fastener. Arm 98 has a bracket 98 that is configured to attach to the columnar support 14 via slots 102 that engage pins 104 that are pressed into the columnar support 14. As shown in FIG. 6, slots 102 are L-shaped to resist loading in the downward direction, but allow release of the curl assembly from the frame 130 by rotating the curl assembly upward.

Figure 7:
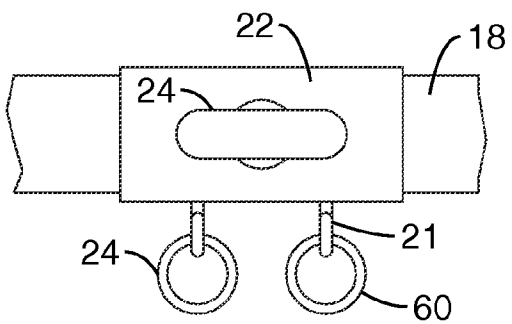
FIG. 7 illustrates a close-up view of a horizontal mount in accordance with the present invention.

Referring to FIGS. 1 and 7, the system 10 may also comprise an upper horizontal beam 18 that is receivable on to the vertical extensions 11, 13. The beam 18 comprises a plurality of locking holes to secure the position of a pair of horizontal mounts 62 that slide horizontally along beam 18. The mounts 62 may be locked into position by securing pull pin 24 into one of holes 40. The mounts 62 have attachment rings 60 secured via eyelets 21 to the bottom end of the mounts. The horizontal mounts not only provide a flexible horizontal attachment point by sliding along beam 18, but also may be adjusted vertically by elevation of vertical extensions 11, 13 in columns 12, 14.

FIG. 8 illustrates a dip assembly 80 that is also configured to be detachably secured to the frame 130. Dip assembly 80 comprises handlebars 82 that are secured to neck 84. Similar to the attachment means provided for the curl assembly 90, the dip assembly has a stem 86 for adjusting the height of the handlebars 82 within the stem 96, and arm 98 has bracket 100 for receiving the dip assembly on column 14. A person may perform dip exercises by lifting his/her torso above the handlebars 82. For additional resistance a first end of an ERT element may be secured to ring 72, with a second end attached to a body member (e.g. to an ankle via an ankle strap, or around the user's waist via a waist belt.)

Figure 10:
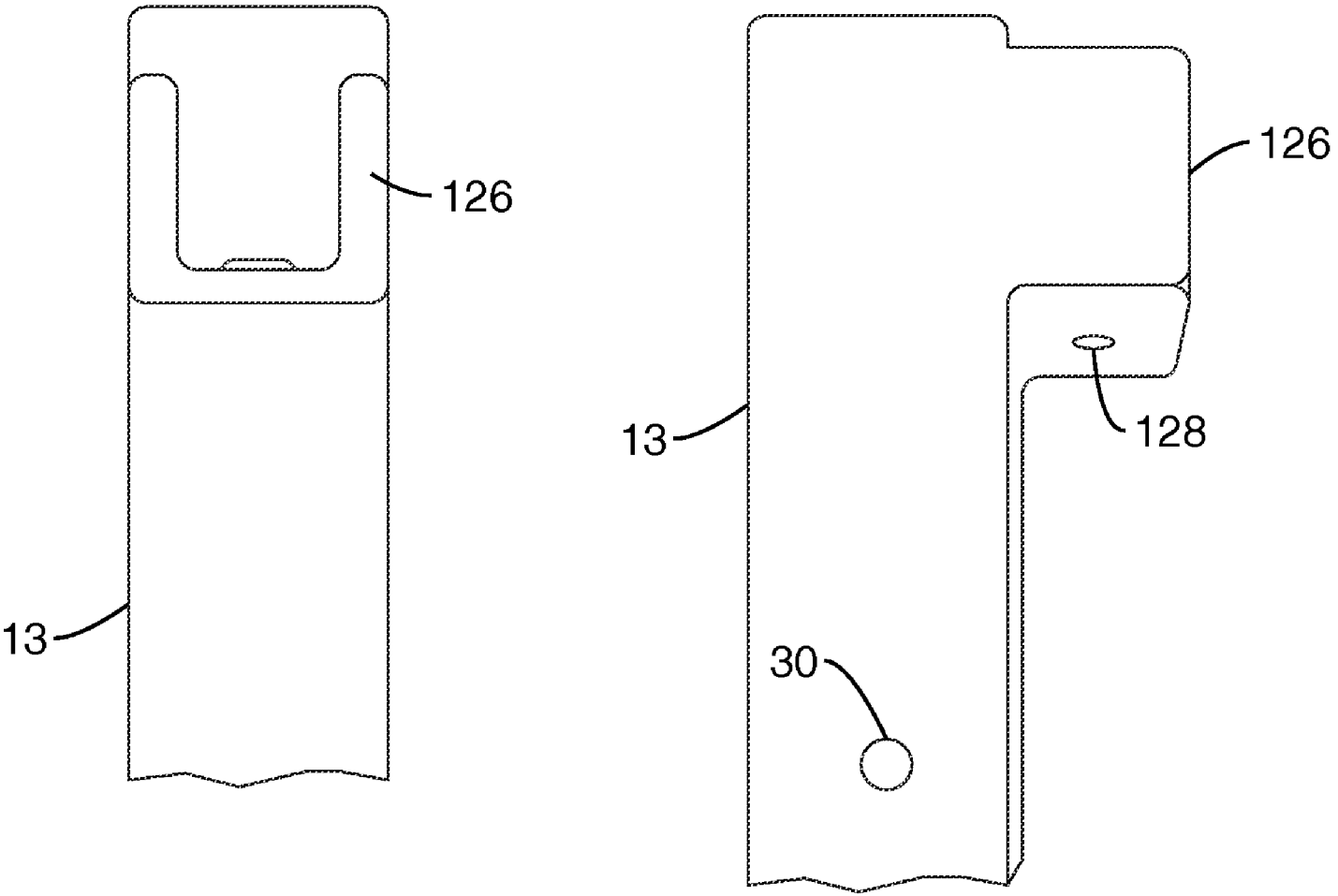
FIG. 10 illustrates close-up views of the vertical extension and receptor for the horizontal beam in accordance with the present invention.

FIG. 10 illustrates the U-shaped protrusion on vertical extension 13 (and mirror image on extension 11) for receiving the upper horizontal beam 18. Through hole 128 is also provided for fastening the beam 18 with a bolt or like fastener.

Figure 11:
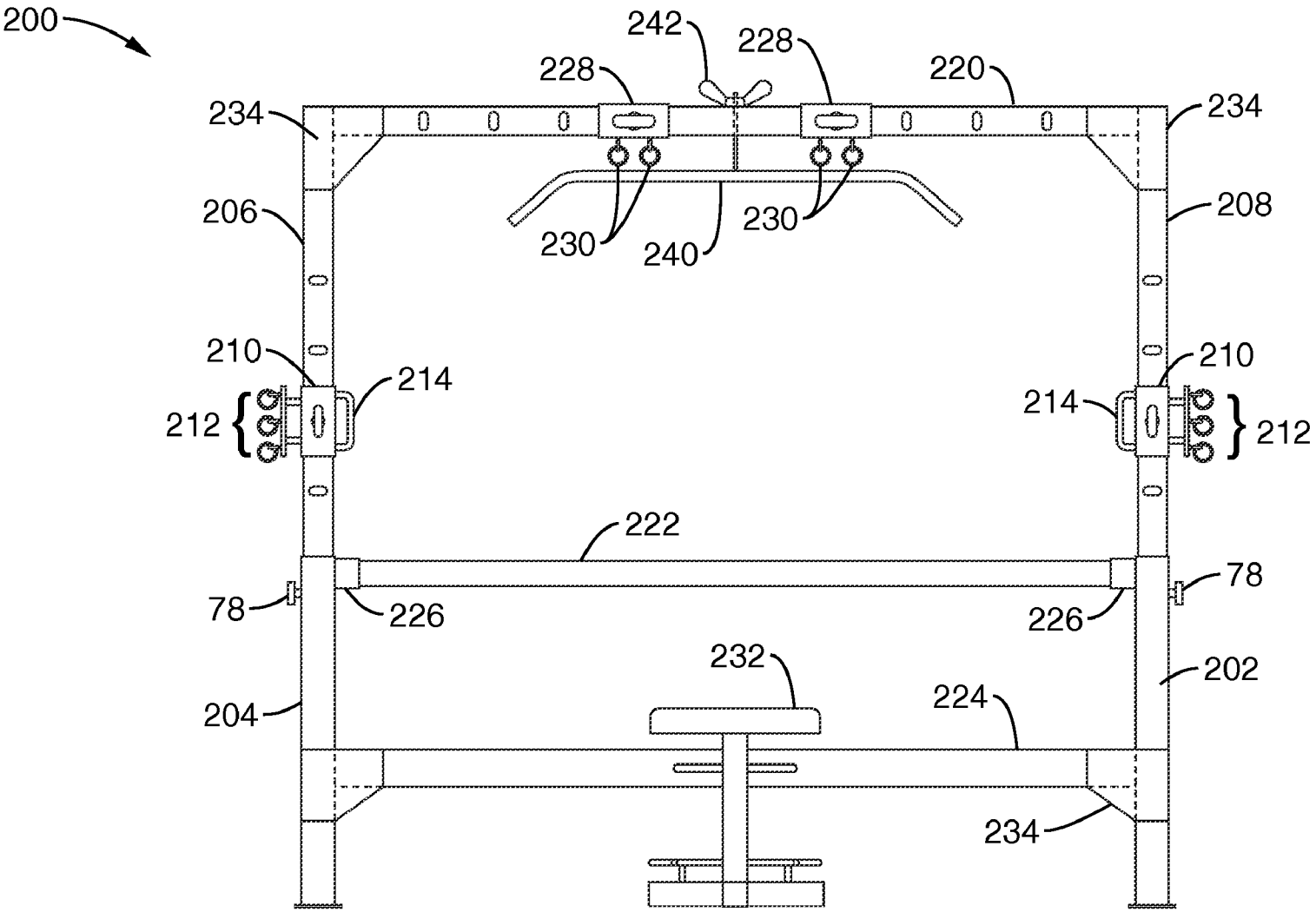
FIG. 11 illustrates a frontal view of an alternative embodiment of the elastic resistance training system of the present invention.

FIG. 11 illustrates an alternative embodiment of elastic resistance training system 200 having shorter vertical columns 202 and 204 that are secured to lower horizontal beam 224 with gusset plates 234. An inverted U-shaped extension frame is inserted into the vertical columns 202 and 204 at extension members 206 and 208. The vertical extension members 206 and 208 are secured to upper horizontal beam 220 via gusset plates 234. The vertical extension members 206 and 208 are also configured to receive vertical mounts 210, which each support attachment rings 212 on the outside surface. The opposing inner surface of supports 210 has handles for adjusting the height of the mounts 210 along the vertical extension members 206, 208. Upper horizontal beam 220 may also support horizontal mounts 228 that each have a plurality of attachment rings 230. Beam 220 may also supports a pull-up bar 240 via fastener 242.

Figure 12:
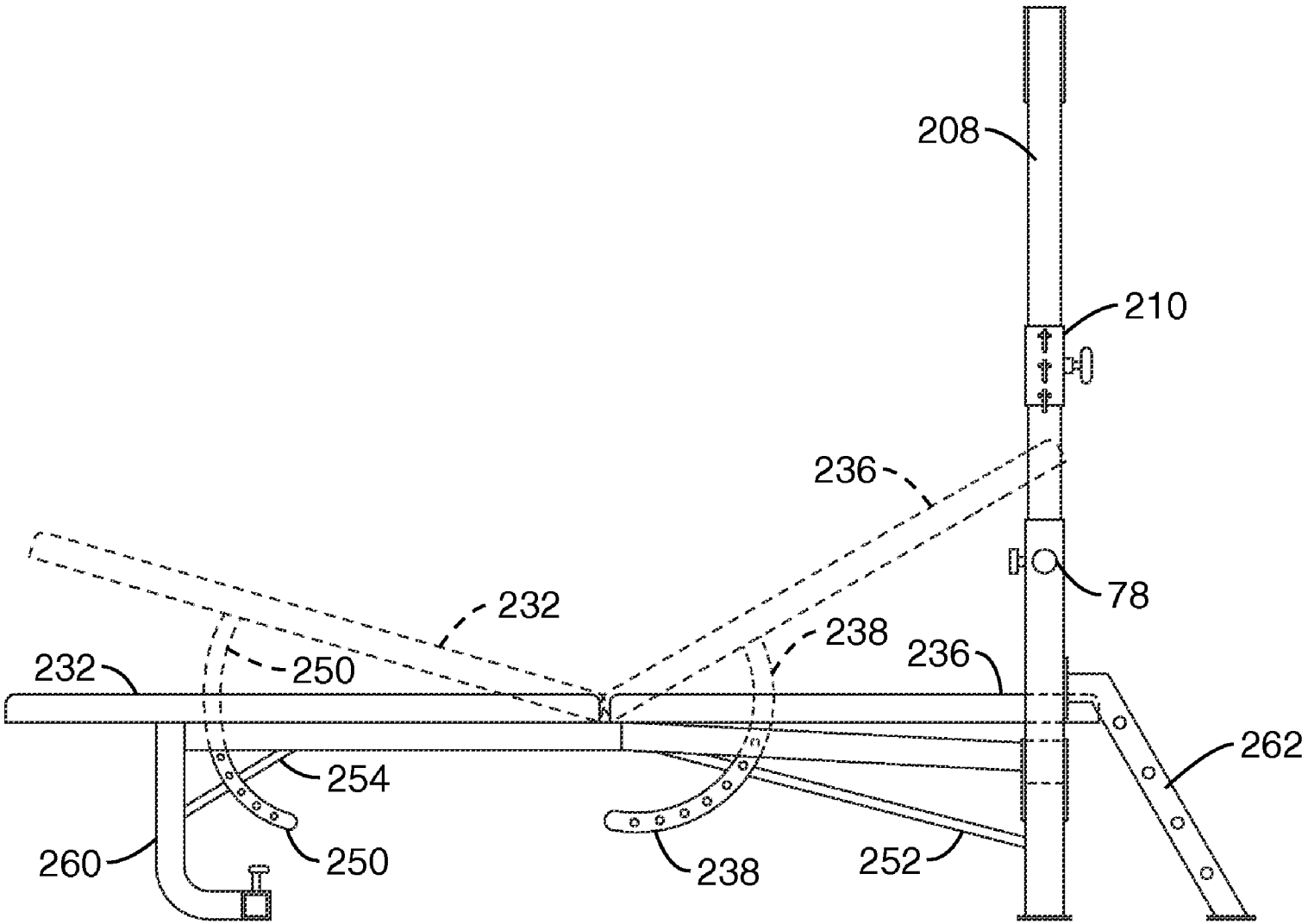
FIG. 12 shows a side view of the system shown in FIG. 1

FIG. 12 illustrates a side view of system 200. In this configuration, both the front pad 232 and rear pad 236 may rotate upward from front support 254 and rear support 252 respectively. The position of the pads 232 and 236 are locked down with curvilinear arms 250 and 238 respectively. The columns 202 and 204 are supported in a vertical orientation via rear supports 262 and leg 260 of the bench.

Although system 10 is illustrated with different features than system 200, it is appreciated that the differing features may be interchangeably implemented where appropriate in either system.

FIGS. 13-20 illustrate various exercises that may be performed using the elastic resistance training system of the present invention. For purposes of simplicity, the exercises are illustrated with use of system 10. However, it is appreciated that many of the exercises may be performed on system 200 in a similar fashion.

Figure 13:
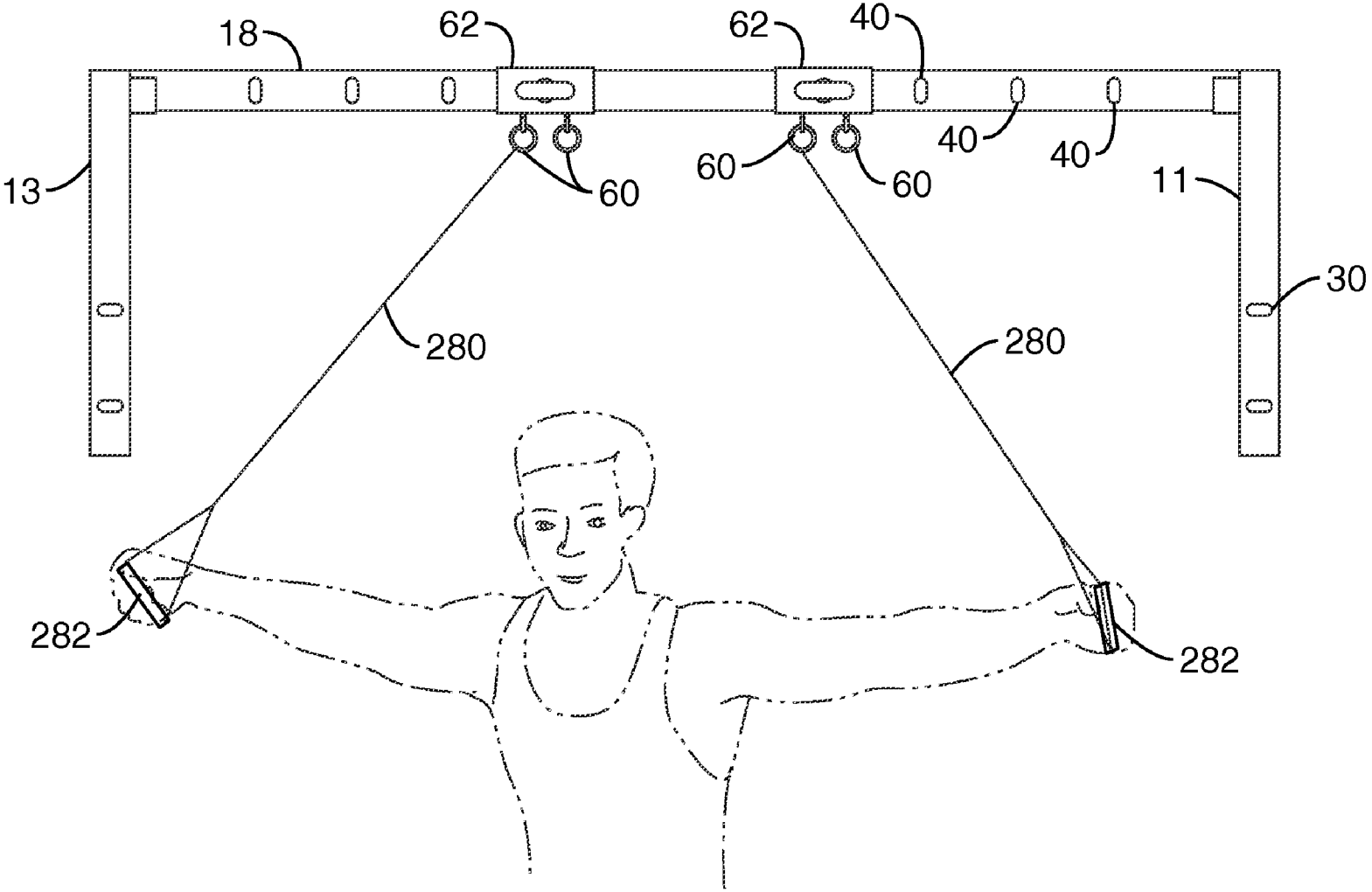
FIG. 13 is a frontal view of a user performing a chest exercise with the elastic resistance training system of the present invention.

FIG. 13 illustrates a frontal view of a person training chest or pectoral muscles with a fly exercise. In this exercise, elastic tubes or bands are attached to rings 60 on horizontal mounts 62. The mounts 62 may be distanced apart from each other on horizontal beam 18 to vary the directionality of the band resistance. In addition, the angle of approach along the bands 280 from ring 60 to handle 282 may be adjusted by adjusting the height of the vertical extensions 11, 13 from columns 12, 14.

In any of the exercises listed above or below, the user may increase the resistance by switching the gauge or number of elastic tubes or bands. In some exercises, a stance further away from the attachment points will also increase loading.

Figure 14:
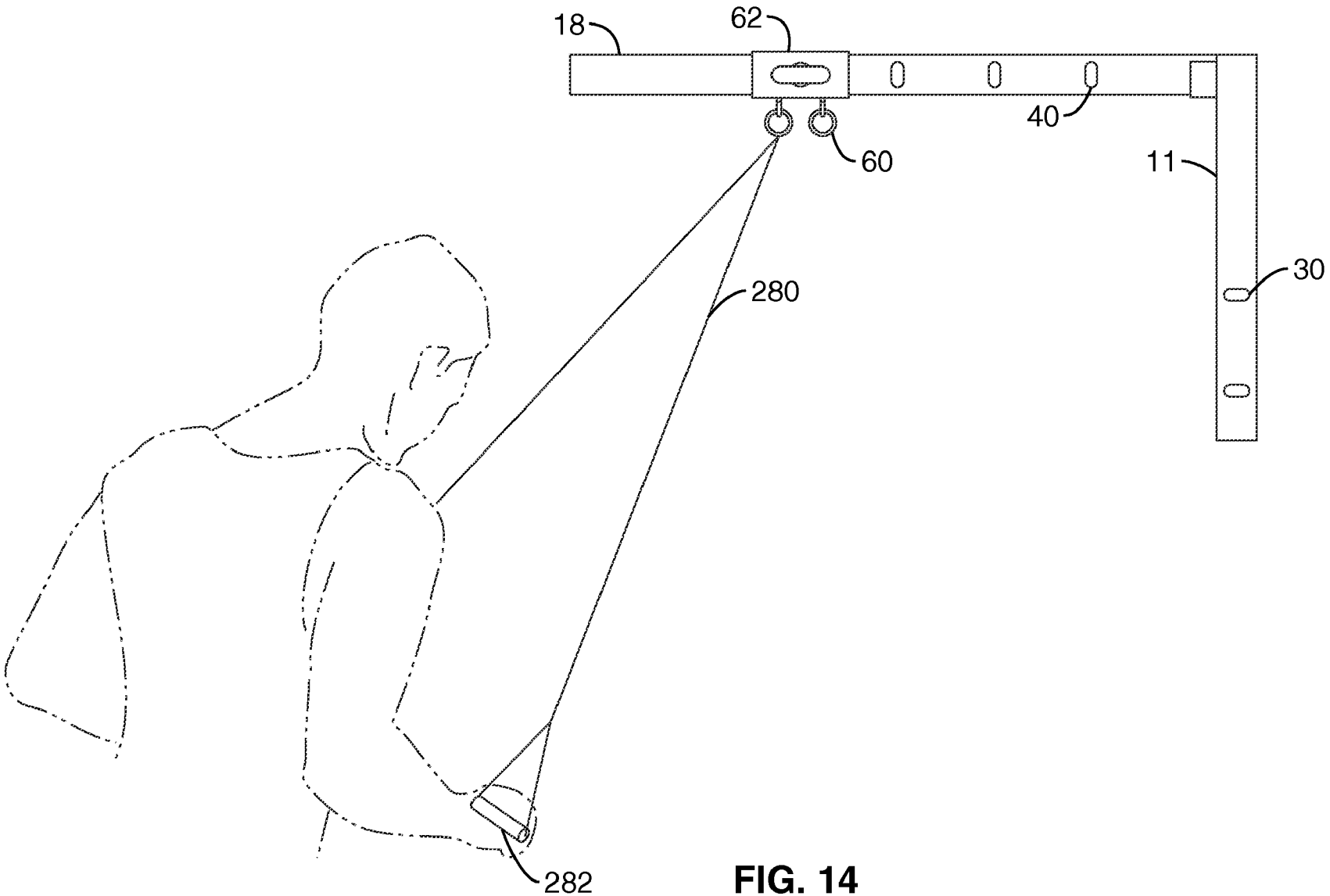
FIG. 14 illustrates a user performing a triceps exercise with the elastic resistance training system of the present invention.

FIG. 14 illustrates a user employing the bands on one of the horizontal mounts 62 to perform a triceps extension. Although both elastic bands are shown linked to the same attachment point, it is appreciated that the individual bands may be attached to the system 10 by separate rings 60.

Figure 15:
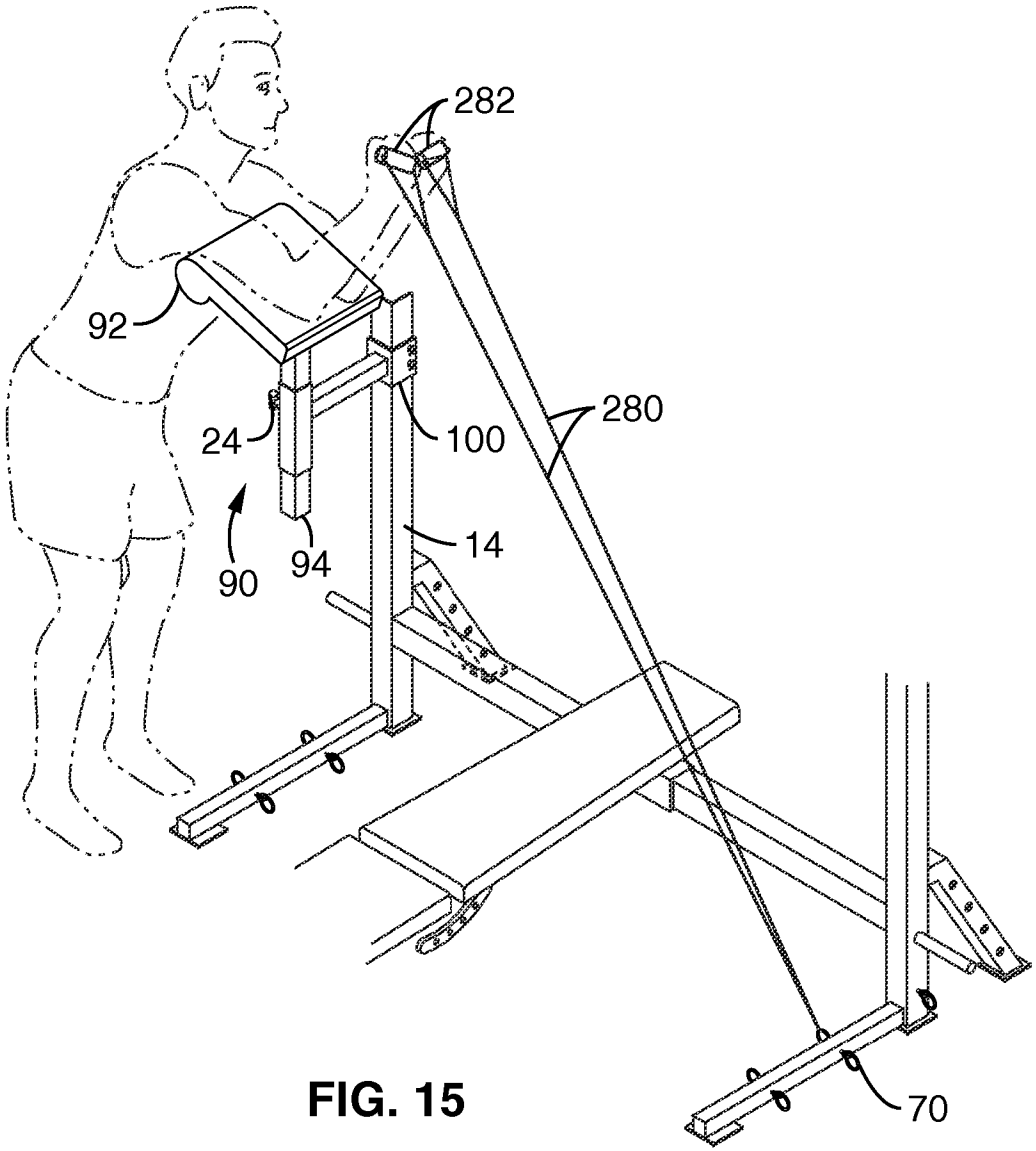
FIG. 15 illustrates a user performing a biceps exercise with the elastic resistance training system of the present invention.

FIG. 15 illustrates a user performing a biceps curl using the curl assembly 90. To perform this exercise, the user's arms lay flat on pad 92, while the user grips handles 282 to pull them toward his head and chest. The opposite ends of bands are secured to one or more attachment points 70 on the opposing forward support 74. The height of the curl pad 92 may be adjusted to the user's height by sliding 94 up or down and locking it in place with pull pin 24. Similar to FIG. 14, both elastic bands are shown linked to the same attachment point. However, is appreciated that the individual bands may be attached to the system 10 by separate spaced apart rings 70.

Figure 16:
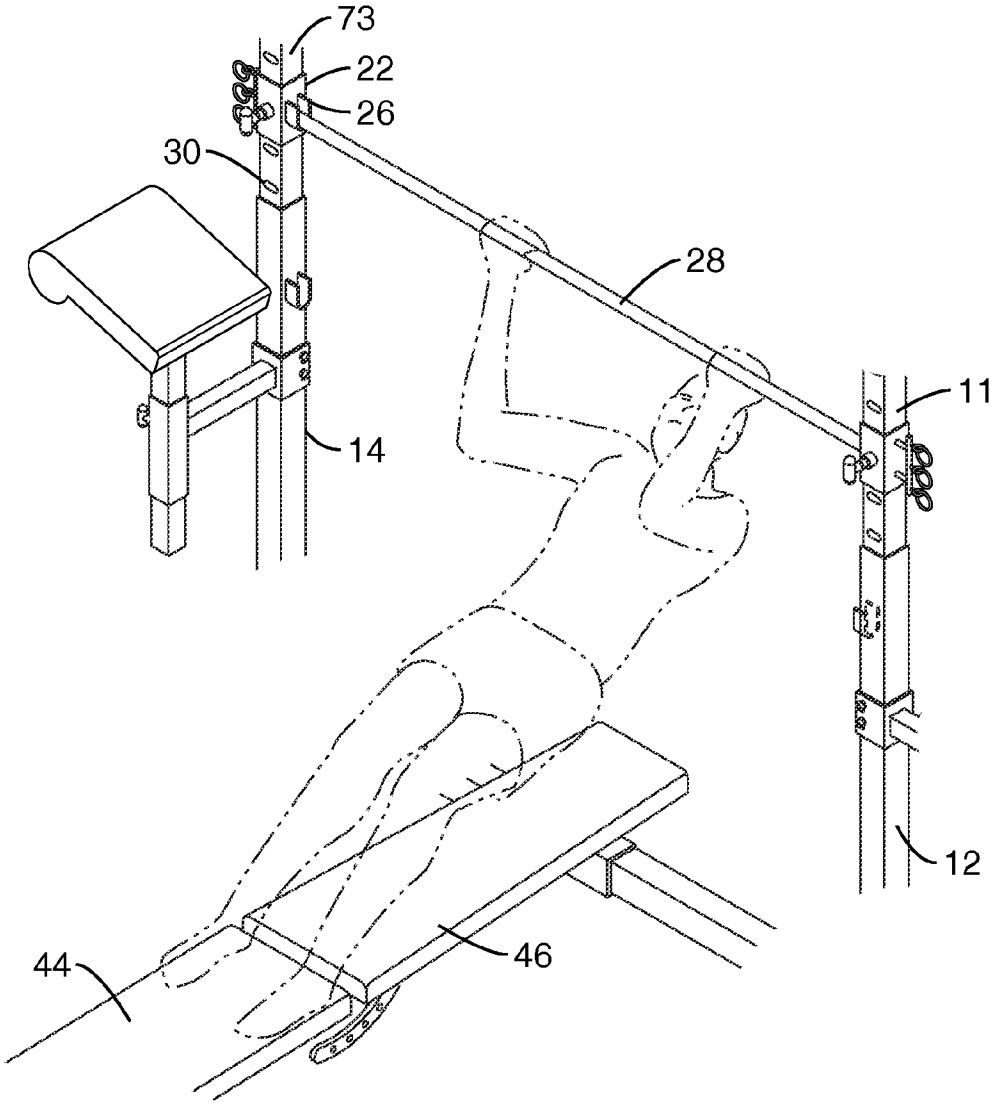
FIG. 16 illustrates a user performing pull-ups with the elastic resistance training system of the present invention.

FIG. 16 illustrates a person performing an assisted chin-up with use of bar 28 and bench 140. The height of bar 28 may be adjusted by adjusting vertical mounts 22 along extensions 11, 13.

Figure 17:
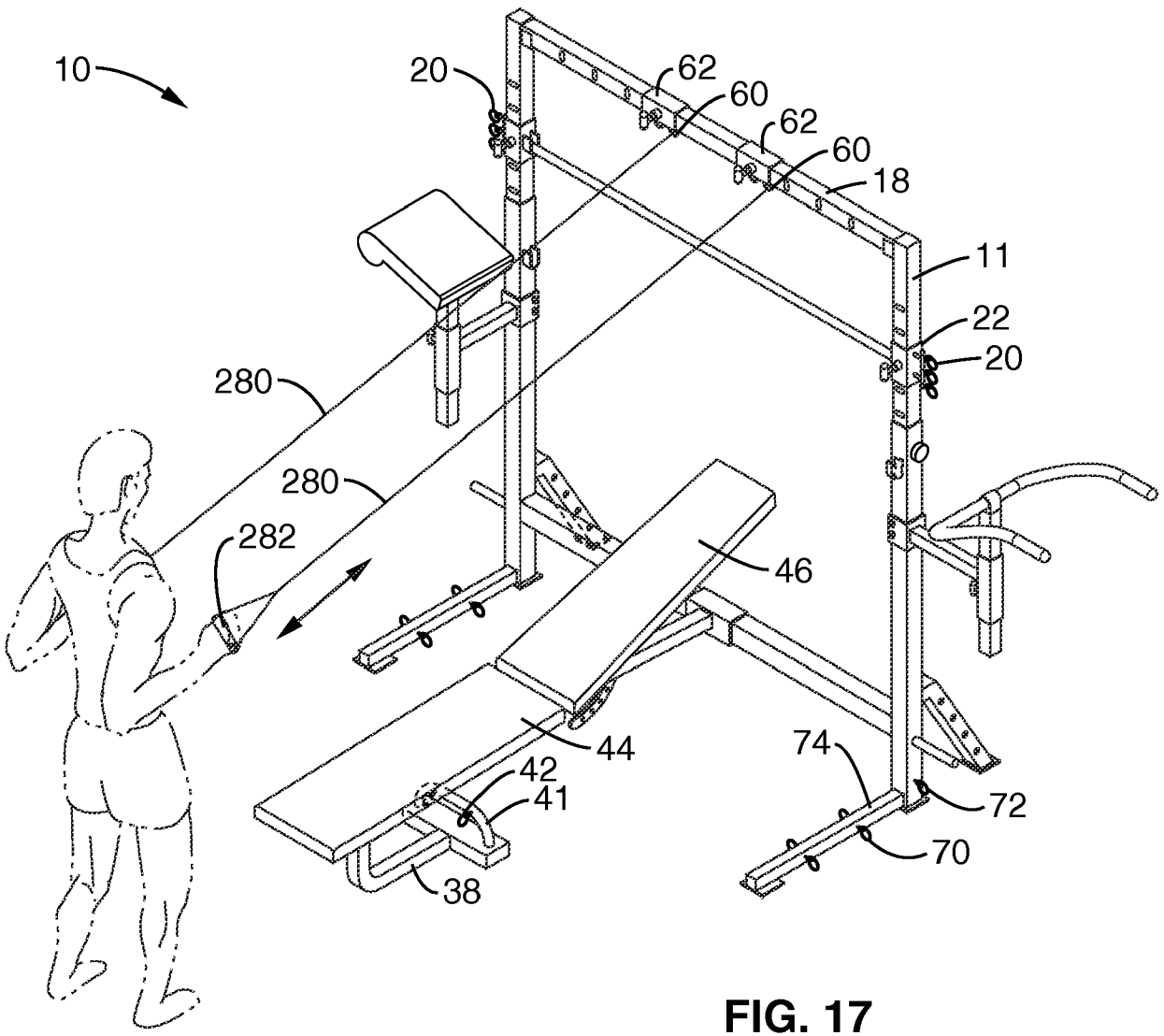
FIG. 17 illustrates a user performing a back exercise with the elastic resistance training system of the present invention.

FIG. 17 illustrates a user performing back (specifically a rowing exercise to train the rhomboid and middle trapezius muscles) exercise with the system 10. The free end of elastic tubes 280 are attached to rings 60 of horizontal mounts 62. The distance between mounts 62 may also be adjusted to vary the width/and or direction of the elastic tubes 280.

Figure 18:
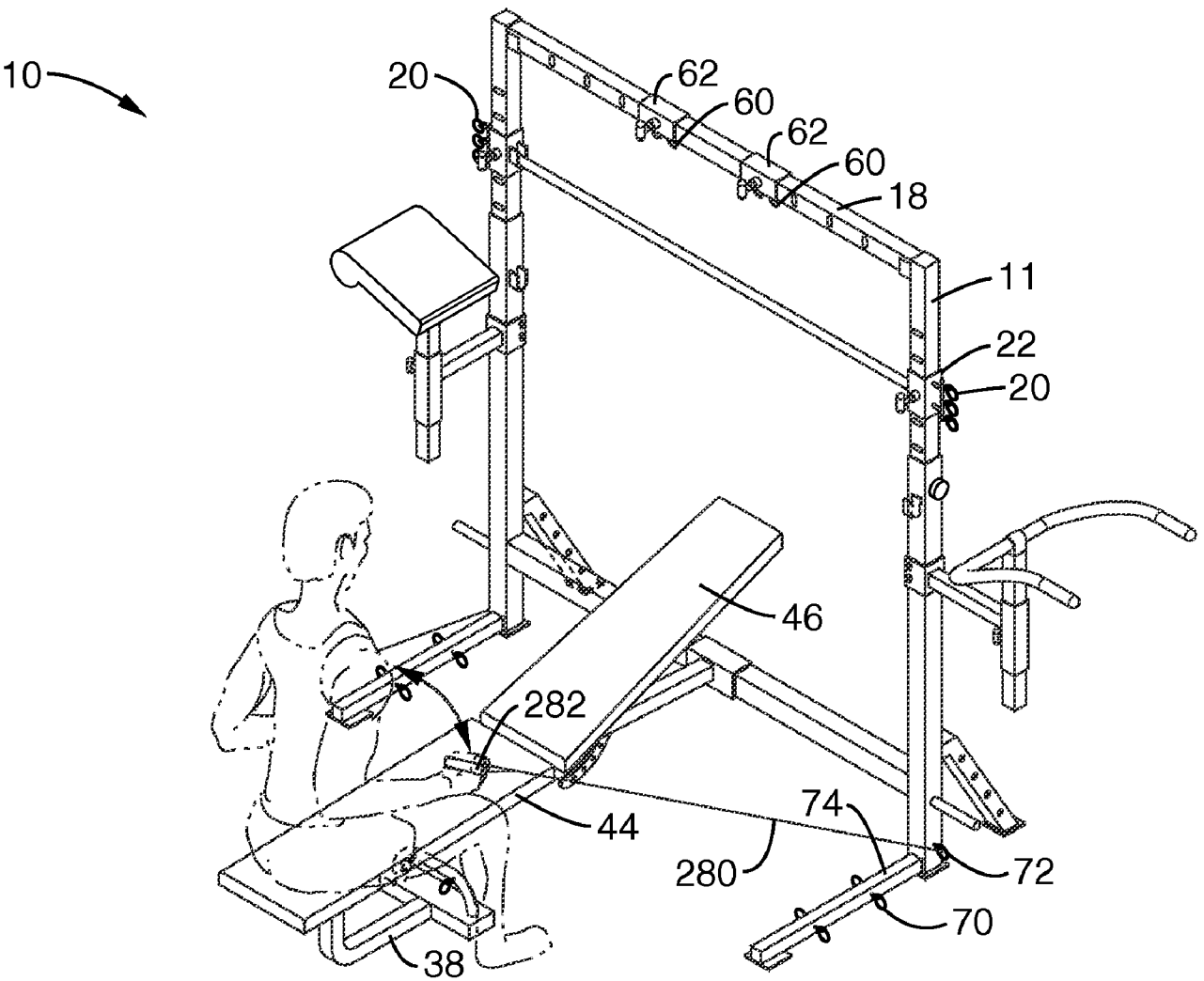
FIG. 18 shows a user performing a biceps exercise with the elastic resistance training system of the present invention.

FIG. 18 illustrates a user performing bicep curls by sitting on bench 140. The elastic tubes 280 are preferably mounted to a lower attachment point (e.g. lower rings 70 or 72). FIG. 18 illustrates the user pointing toward the frame 130. However, curls may also be performed with the person sitting sideways on bench 140 with torso pointing towards either of the frontal supports 74 and rings 70.

Figure 19:
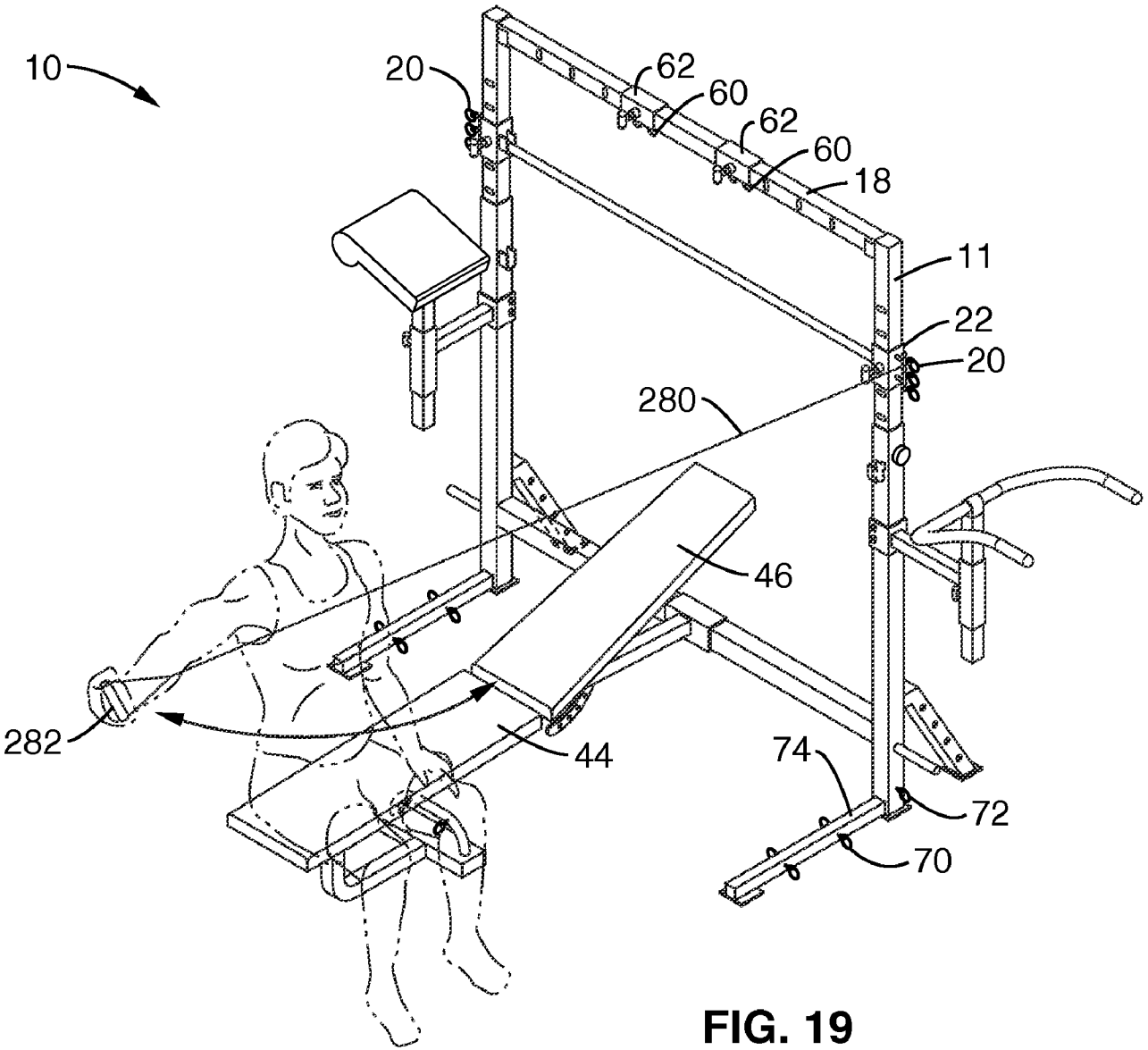
FIG. 19 illustrates a user performing a shoulder exercise with the elastic resistance training system of the present invention.

FIG. 19 illustrates a user training shoulder muscles (e.g. posterior deltoid, teres major, infraspinatus) with one elastic tube 280 coupled to a ring 20 on vertical mount 22. The height of mount 22 may be adjusted according to the user's height by positioning it in appropriate slot 30. To perform the opposite arm, the user may turn 180 degrees and use the second mount 22.

Figure 20:
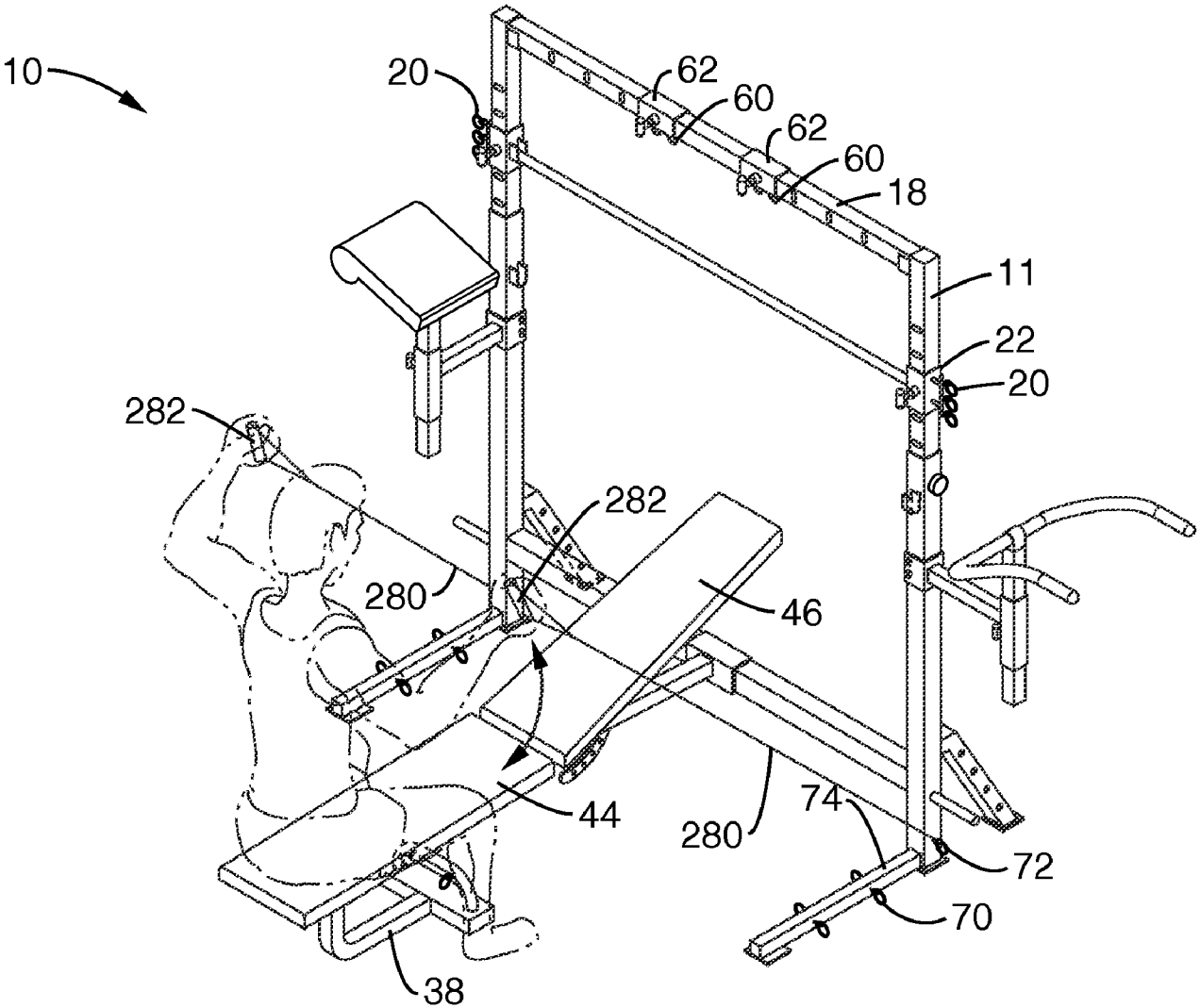
FIG. 20 illustrates a user performing another shoulder exercise with the elastic resistance training system of the present invention.

FIG. 20 shows a user performing another shoulder exercise (lateral raises) with the elastic tubes 280 attached to a lower attachment point (lower rings 72). This exercise concentrates training on a similar, but different group of muscles (upper trapezium, posterior deltoid, upper rhomboid). The user may also adjust the angle of resistance by adjusting his/her position on the seat or using other lower rings 70.

Figure 21:
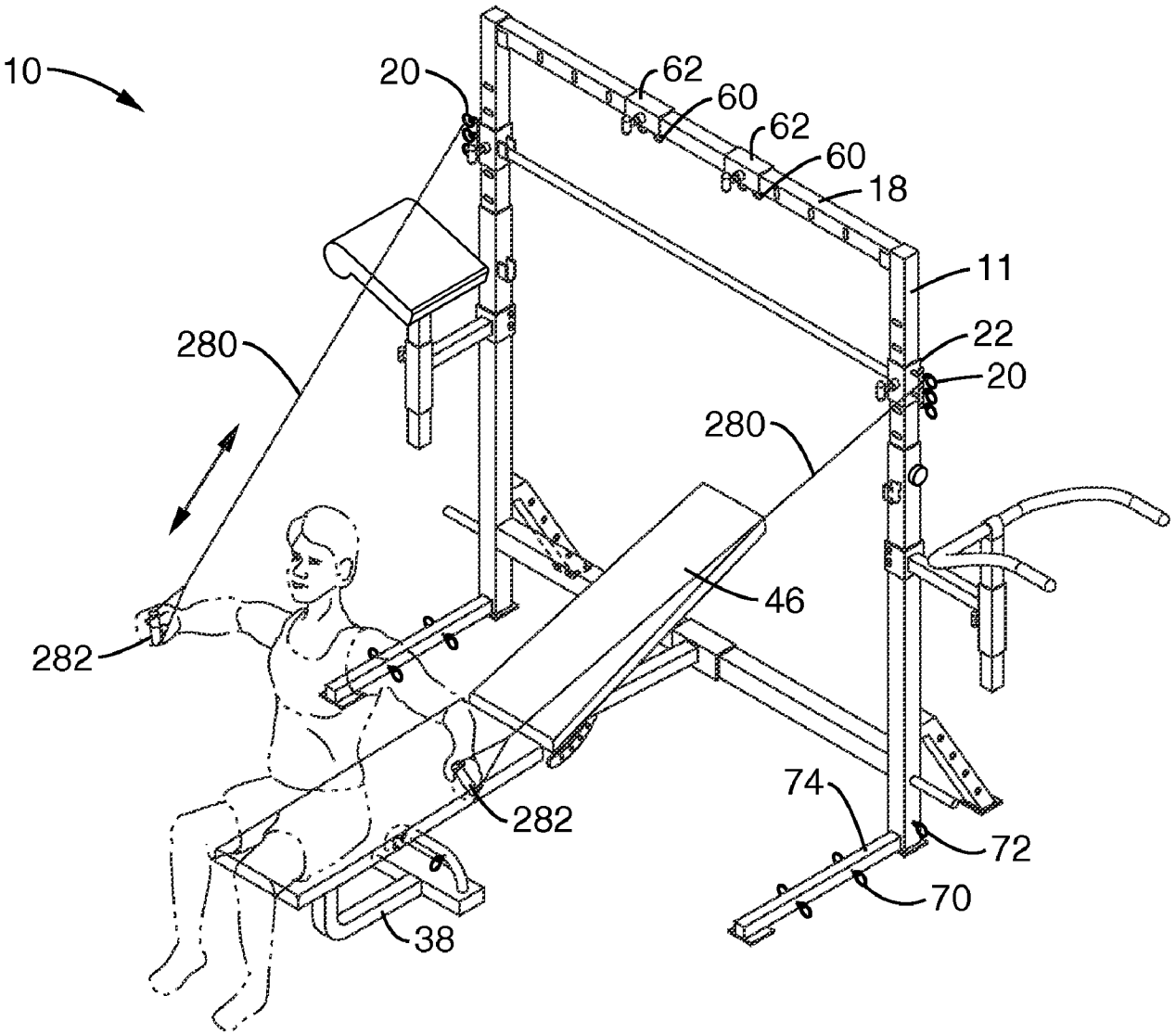
FIG. 21 shows a user performing a chest exercise with the elastic resistance training system of the present invention.

FIG. 21 illustrates a user performing chest fly exercises to train the pectoral muscles. Location of attachment points 20 may be varied to change the incline of the resistance. Lower attachment points 70, 72 may also be used to vary the exercise. A chest press exercise may also be performed by rotating the grip orientation of handles 282 to be substantially horizontal.

Figure 22:
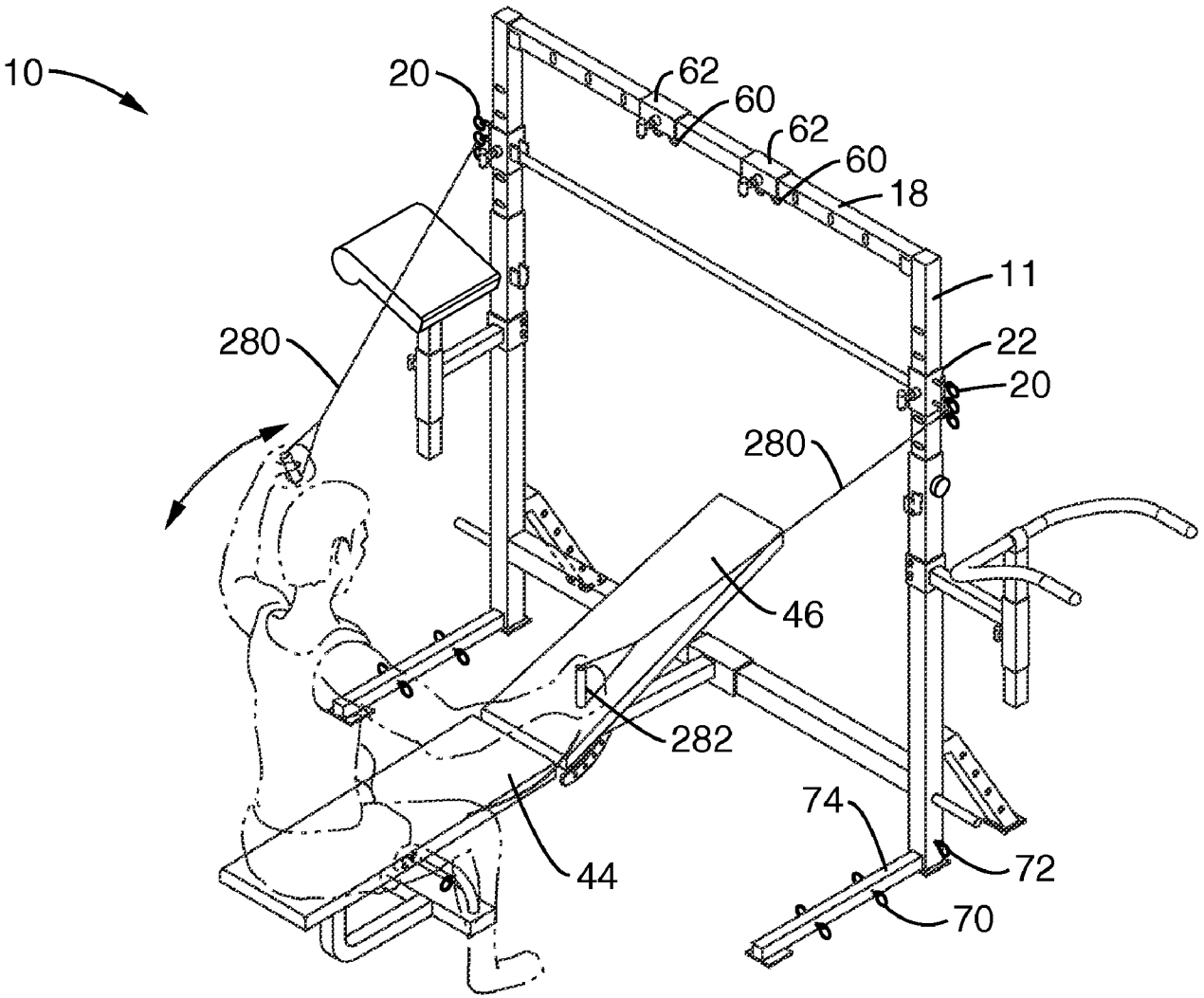
FIG. 22 illustrates a user performing a shoulder exercise with the elastic resistance training system of the present invention.

FIG. 22 illustrates system 10 being used for a reverse-fly or back exercise (e.g. to train posterior deltoid, rhomboid, middle trapezius muscles). Micro-adjustment may be obtained by changing the location of vertical mounts 22.

Figure 23:
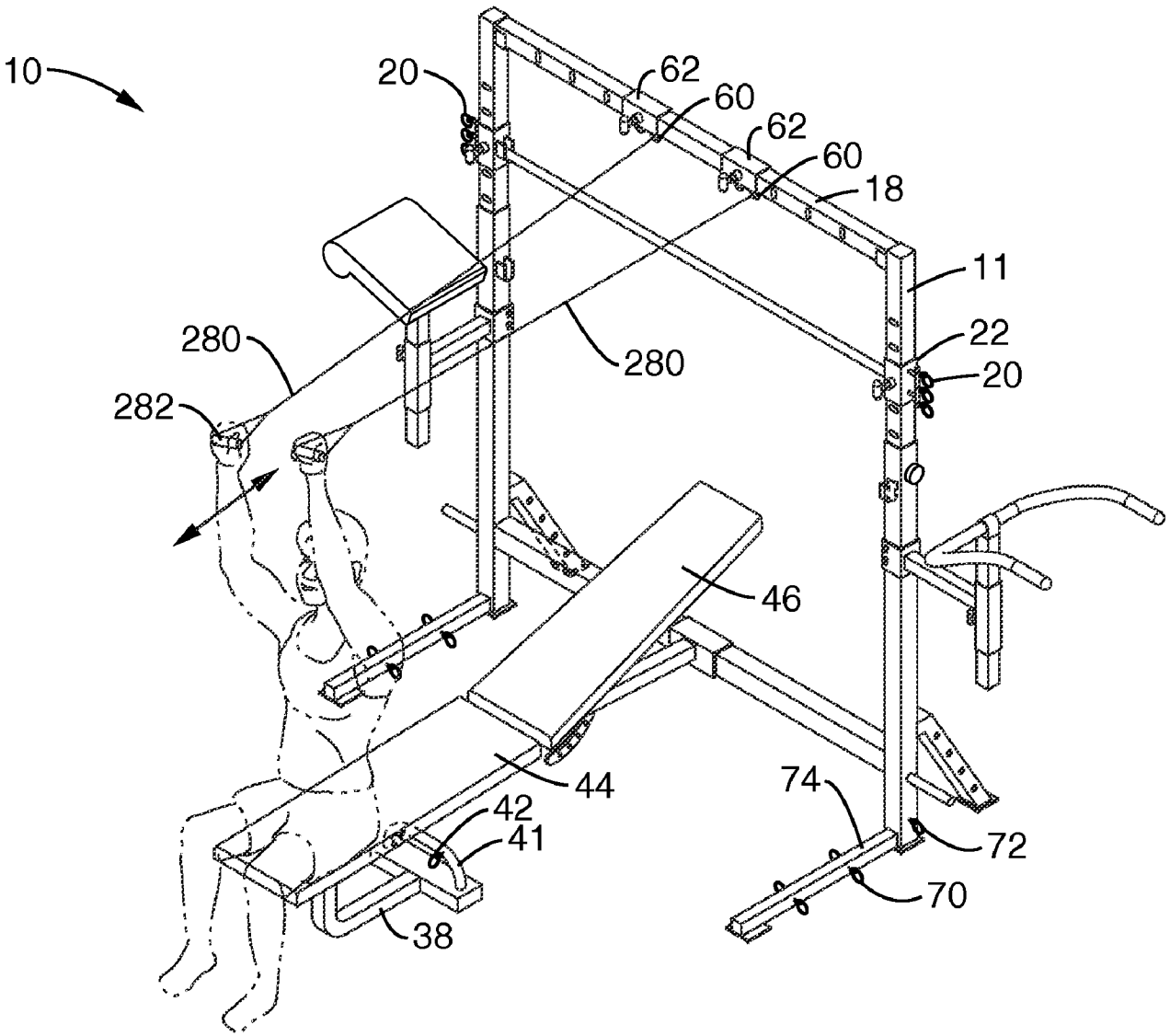
FIG. 23 shows a user performing a triceps exercise with the elastic resistance training system of the present invention.
Figure 24:
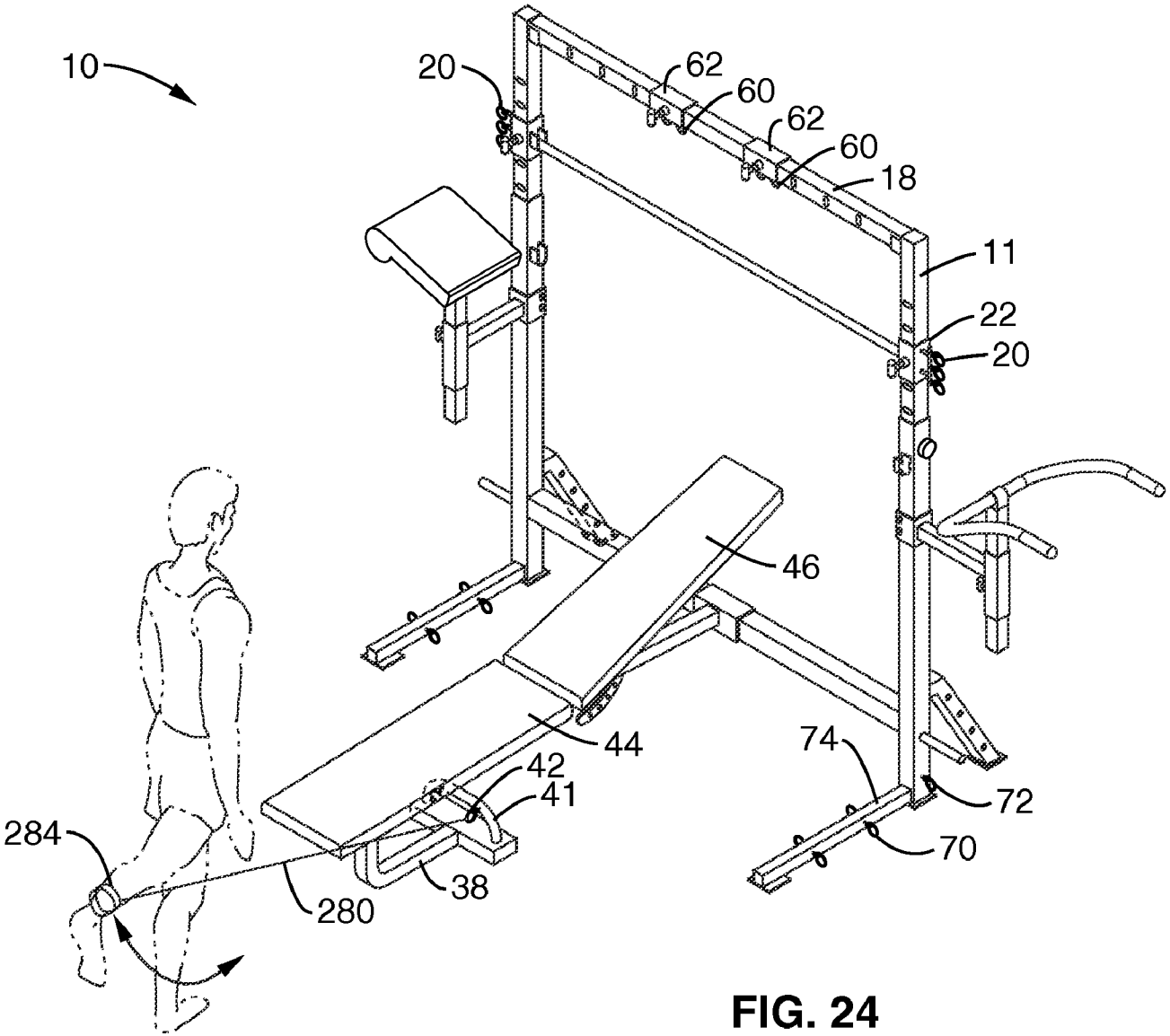
FIG. 24 illustrates a user performing a leg exercise with the elastic resistance training system of the present invention.

FIG. 23 shows a person performing over-head triceps exercises by attaching straps 280 to upper attachment points 60. The width of attachment points 60 may be varied by adjusting the horizontal mounts 62, FIG. 24 illustrates a person using system 10 for performing leg exercises with use of the lower attachment points 42 located on the leg 38 of bench 140. As illustrated in FIG. 24, the free end of elastic tubing 280 is coupled to an ankle strap 284, and the user is pointing toward frame 130 to concentrate on the hamstrings and gluteus maximus muscle groups. It is also appreciated that the user may point sideways, or 90 degrees away from the frame, to train the gluteus medius and iliotibial band.

Figure 25:
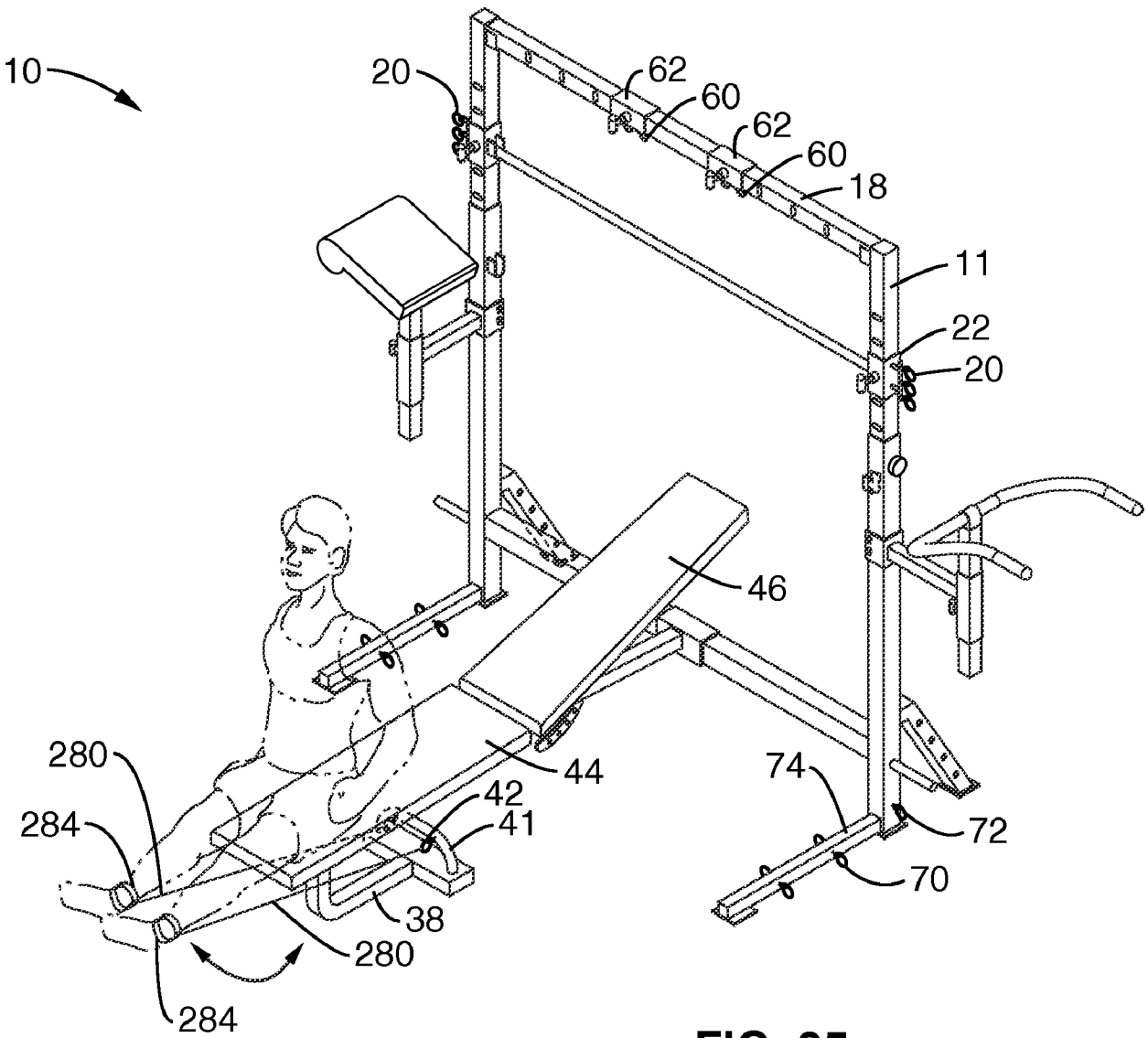
FIG. 25 shows a user performing a leg extension exercise with the elastic resistance training system of the present invention.

FIG. 25 shows a person using system 10 to perform leg extension exercises (e.g. to train the quadriceps muscles). For this exercise, the person sits on the end of bench 140 at pad 44. Ankle cuffs secure the free end of elastic band 280 around one or both of the ankles of the user. The other end is attached to one or both of lower attachment rings 42. The user then extends his/her legs to extend the elastic bands 280

Figure 26:
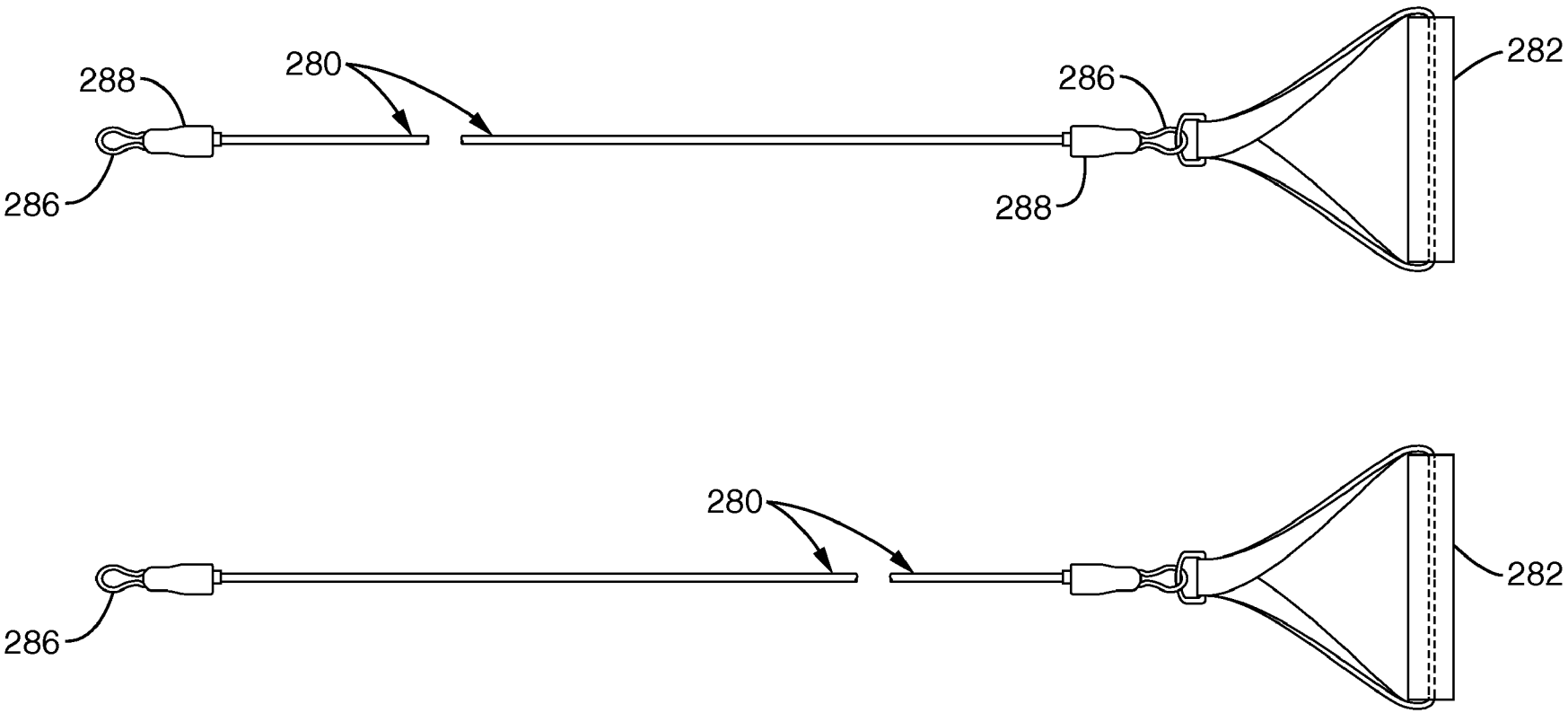
FIG. 26 illustrates the elastic resistance training elements of the present invention.

FIG. 26 illustrates elastic elements 280 in further detail couple to handles 282 at one end. For the purpose of the present invention, it is appreciated that the elastic element may comprise a variety of different forms. For example, the elastic element may be a band, tube, or like resistive element. As shown in FIG. 26, elastic elements 280 comprise tubes that are generally two feet long and terminate at fabric coupling 288 at each end. Each coupling 288 has a loop to attach a metal clip 286, e.g. carabineer, which can be releasably attached to an attachment ring, or handle or other implement. The coupling 288 material may comprise a e.g. heavy nylon webbing or the like material that is capable of withstanding large tensile loads.

The elastic elements 280 may be provided as a set of elastic tubes that have different colors: e.g. yellow, green, red and blue, each color corresponding to a different resistance. Two or three elastic tubes can be attached to one handle 286 and attachment point of pull on the system 10. For example, one can combine red and green on handle for more resistance, or any other combinations of colors. Although the elastic elements 280 shown in FIG. 26 are preferred, it is appreciate that any elastic element, e.g. band, tubing or the like, currently available in the art may be used in the present invention.

As illustrated in the FIGS. 1-26 the exercise system of the present invention may be used to perform all major muscle groups (e.g. chest, back shoulders, abdominal, arms, legs, etc.) The mobility and varying location of attachment points, along with multiple stations, allow a plurality of people to train on the system simultaneously (up to seven or more people at a time). The ERT exercises may be performed sitting, standing, laying down or elevated. In addition, the frame, supports, and tubing are constructed so that a user does not need to be sitting or standing on the system to prevent the system from sliding in its place, or to be wall mounted for stability.

Although the description above contains many details, these should not be construed as limiting the scope of the invention but as merely providing illustrations of some of the presently preferred embodiments of this invention. Therefore, it will be appreciated that the scope of the present invention fully encompasses other embodiments which may become obvious to those skilled in the art, and that the scope of the present invention is accordingly to be limited by nothing other than the appended claims, in which reference to an element in the singular is not intended to mean "one and only one" unless explicitly so stated, but rather "one or more." All structural, chemical, and functional equivalents to the elements of the above-described preferred embodiment that are known to those of ordinary skill in the art are expressly incorporated herein by reference and are intended to be encompassed by the present claims. Moreover, it is not necessary for a device or method to address each and every problem sought to be solved by the present invention, for it to be encompassed by the present claims. Furthermore, no element, component, or method step in the present disclosure is intended to be dedicated to the public regardless of whether the element, component, or method step is explicitly recited in the claims. No claim element herein is to be construed under the provisions of 35 U.S.C. 112, sixth paragraph, unless the element is expressly recited using the phrase "means for."

What is claimed is:

1. An exercise system, comprising:

a frame having first and second vertical columns;

the frame comprising one or more supports configured to rest on a floor surface to maintain the frame in a substantially vertical orientation;

first and second extendable members;

said first and second extendable members slideably disposed within said first and second vertical columns; and one or more rings coupled to the first and second extendable members; a horizontal beam between said members;

wherein the one or more rings function as attachment points to secure one or more elastic resistance training elements to the system;

wherein the position of the one or more rings is adjustable to allow a variety of exercises with the elastic training element; and wherein the one or more rings are disposed on a first mount;

said first mount being slideably disposed on one of the first and second extendable members so that the vertical position of the first mount with respect to the frame may be varied.

2. An exercise system as recited in claim 1, further comprising:

said horizontal beam spanning the first and second extendable members;

the horizontal beam having one or more attachment rings;

said attachment rings providing additional attachment points for the one or more elastic resistance training elements.

3. An exercise system as recited in claim 2, further comprising:

a second mount slideably disposed on the horizontal beam;

the second mount comprising one or more attachment rings;

wherein the second mount is configured to slide along the horizontal beam to vary the location of said one or more attachment rings.

4. An exercise system as recited in claim 3, wherein the first mount and second mount are configured to lock into place at a plurality of locations.

5. An exercise system, comprising:

a frame having first and second vertical columns;

the frame comprising one or more supports configured to rest on a floor surface to maintain the frame in a substantially vertical orientation;

first and second extendable members;

said first and second extendable members slideably disposed within said first and second vertical columns; and one or more rings coupled to the first and second extendable members;

wherein the one or more rings function as attachment points to secure one or more elastic resistance training elements to the system;

wherein the position of the one or more rings is adjustable to allow a variety of exercises with the elastic training element; and a bench having a flat surface for a user to rest while performing an exercise;

the bench having a first end secured to the frame and a second free end having a leg configured to support the frame on a floor surface.

6. An exercise system as recited in claim 5, wherein the bench comprises a pad configured to elevate to a plurality of angles with respect to a floor surface.

7. An exercise system, comprising:

a frame having first and second vertical columns;

the frame comprising one or more supports configured to rest on a floor surface to maintain the frame in a substantially vertical orientation;

first and second extendable members;

said first and second extendable members slideably disposed within said first and second vertical columns;

one or more rings coupled to the first and second extendable members;

wherein the one or more rings function as attachment points to secure one or more elastic resistance training elements to the system;

wherein the position of the one or more rings is adjustable to allow a variety of exercises with the elastic training element; and an elevated work surface attached to one of the vertical columns;

the elevated work surface providing a platform to rest a body member while loading said one or more elastic elements.

8. An exercise system, comprising:

a frame having first and second vertical columns;

the frame comprising one or more supports configured to rest on a floor surface to maintain the frame in a substantially vertical orientation;

first and second extendable members;

said first and second extendable members slideably disposed within said first and second vertical columns;

one or more rings coupled to the first and second extendable members;

wherein the one or more rings function as attachment points to secure one or more elastic resistance training elements to the system;

wherein the position of the one or more rings is adjustable to allow a variety of exercises with the elastic training element; and one or more attachment points coupled to the frame at locations at or near the floor surface.

9. An exercise system, comprising:

a frame having first and second vertical columns;

the frame comprising one or more supports configured to rest on a floor surface to maintain the frame in a substantially vertical orientation;

a bench having a first end attached to a horizontal beam spanning the first and second vertical columns and a second end having a leg to support the bench on a floor surface;

the bench having a planar surface from which a user can rest at least a portion of the body;

one or more lower attachment rings coupled to the frame;

wherein the one or more lower attachment rings are at a location on the frame that is below the planar surface of the bench;

wherein the one or more lower attachment rings function as attachment points to secure one or more elastic resistance training elements to the system from which the user can train a body member while resting at least a portion of the body against the bench; and one or more upper attachment rings coupled to the frame;

wherein the one or more upper attachment rings are at a location that is above the planar surface of the bench; and wherein the one or more upper attachment rings function as attachment points to secure one or more elastic resistance training elements to the system.

10. An exercise system as recited in claim 9, further comprising:

first and second extendable members;

said first and second extendable members slideably disposed within said first and second vertical columns; and wherein the one or more upper attachment rings are coupled to the first and second extendable members;

wherein the position of the one or more rings is adjustable to allow a variety of exercises with the elastic training element.

11. An exercise system as recited in claim 10:

wherein the one or more upper attachment rings are disposed on a first mount;

said first mount being slideably disposed on one of the first and second extendable members so that the vertical position of the first mount with respect to the frame may be varied.

12. An exercise system as recited in claim 11, further comprising:

a horizontal beam spanning the first and second extendable members;

the horizontal beam having one or more attachment rings;

said attachment rings providing additional attachment points for the one or more elastic resistance training elements.

13. An exercise system as recited in claim 12, further comprising:

a second mount slideably disposed on the horizontal beam;

the second mount comprising one or more attachment rings;

wherein the second mount is configured to slide along the horizontal beam to vary the location of said one or more attachment rings.

14. An exercise system as recited in claim 13, wherein the first mount and second mount are configured to lock into place at a plurality of locations.

15. An exercise system, comprising:

a frame having first and second vertical columns;

the frame comprising one or more supports configured to rest on a floor surface to maintain the frame in a substantially vertical orientation;

a bench having a first end attached to a horizontal beam spanning the first and second vertical columns and a second end having a leg to support the bench on a floor surface;

the bench having a planar surface from which a user can rest at least a portion of the body;

one or more lower attachment rings coupled to the frame;

wherein the one or more lower attachment rings are at a location on the frame that is below the planar surface of the bench;

wherein the one or more lower attachment rings function as attachment points to secure one or more elastic resistance training elements to the system from which the user can train a body member while resting at least a portion of the body against the bench; and an elevated work surface attached to one of the vertical columns;

the elevated work surface providing a platform to rest a body member while loading said one or more elastic elements.

16. An exercise system, comprising:

a frame having first and second vertical columns;

the frame comprising one or more supports configured to rest on a floor surface to maintain the frame in a substantially vertical orientation;

a bench having a first end attached to a horizontal beam spanning the first and second vertical columns and a second end having a leg to support the bench on a floor surface;

the bench having a planar surface from which a user can rest at least a portion of the body;

one or more lower attachment rings coupled to the frame;

wherein the one or more lower attachment rings are at a location on the frame that is below the planar surface of the bench;

wherein the one or more lower attachment rings function as attachment points to secure one or more elastic resistance training elements to the system from which the user can train a body member while resting at least a portion of the body against the bench; and one or more lower attachment points coupled to the frame at locations at or near the floor surface.

17. An exercise system as recited in claim 16, wherein the lower attachment points are coupled to the bench foot to facilitate leg training.

18. An exercise system for use with elastic resistance training elements, comprising:

a frame having first and second vertical columns;

the frame comprising one or more supports configured to rest on a floor surface to maintain the frame in a substantially vertical orientation;

first and second extendable members;

said first and second extendable members slideably disposed within said first and second vertical columns;

a first set of attachment rings coupled to the first and second extendable members;

wherein the attachment rings function as attachment points to secure one or more elastic resistance training elements to the system;

wherein the position of the first set of attachment rings is vertically adjustable to allow a variety of exercises with the elastic training element;

a horizontal beam spanning the first and second extendable members; and a second set of attachment rings coupled to the horizontal beam;

wherein the position of the second set of attachment rings is horizontally adjustable;

wherein the first set of rings is disposed on a first mount;

the first mount being slideably disposed on one of the first and second extendable members so that the vertical position of the first mount with respect to the frame may be varied; and wherein the second set of rings is disposed on a second mount;

the second mount being slideably disposed on one of the horizontal beam so that the horizontal position of the second mount with respect to the frame may be varied.

19. An exercise system as recited in claim 18, wherein the first mount and second mount are configured to lock into place at a plurality of locations.

20. An exercise system for use with elastic resistance training elements, comprising:

a frame having first and second vertical columns;

the frame comprising one or more supports configured to rest on a floor surface to maintain the frame in a substantially vertical orientation;

first and second extendable members;

said first and second extendable members slideably disposed within said first and second vertical columns;

a first set of attachment rings coupled to the first and second extendable members;

wherein the attachment rings function as attachment points to secure one or more elastic resistance training elements to the system;

wherein the position of the first set of attachment rings is vertically adjustable to allow a variety of exercises with the elastic training element;

a horizontal beam spanning the first and second extendable members; and a second set of attachment rings coupled to the horizontal beam;

wherein the position of the second set of attachment rings is horizontally adjustable;

a bench having a flat surface for a user to rest while performing an exercise;

the bench having a first end secured to the frame and a second free end having a leg configured to support the frame on a floor surface.

21. An exercise system for use with elastic resistance training elements, comprising:

a frame having first and second vertical columns;

the frame comprising one or more supports configured to rest on a floor surface to maintain the frame in a substantially vertical orientation;

first and second extendable members;

said first and second extendable members slideably disposed within said first and second vertical columns;

a first set of attachment rings coupled to the first and second extendable members;

wherein the attachment rings function as attachment points to secure one or more elastic resistance training elements to the system;

wherein the position of the first set of attachment rings is vertically adjustable to allow a variety of exercises with the elastic training element;

a horizontal beam spanning the first and second extendable members;

a second set of attachment rings coupled to the horizontal beam;

wherein the position of the second set of attachment rings is horizontally adjustable; and an elevated work surface attached to one of the vertical columns;

the elevated work surface providing a platform to rest a body member while loading said one or more elastic elements.

22. An exercise system for use with elastic resistance training elements, comprising:

a frame having first and second vertical columns;

the frame comprising one or more supports configured to rest on a floor surface to maintain the frame in a substantially vertical orientation;

first and second extendable members;

said first and second extendable members slideably disposed within said first and second vertical columns;

a first set of attachment rings coupled to the first and second extendable members;

wherein the attachment rings function as attachment points to secure one or more elastic resistance training elements to the system;

wherein the position of the first set of attachment rings is vertically adjustable to allow a variety of exercises with the elastic training element;

a horizontal beam snapping the first and second extendable members;

a second set of attachment rings coupled to the horizontal beam;

wherein the position of the second set of attachment rings is horizontally adjustable; and one or more attachment points coupled to the frame at locations at or near the floor surface.

* * * * *